US010241428B2

(12) United States Patent
Shimizu et al.

(10) Patent No.: US 10,241,428 B2
(45) **Date of Patent: *Mar. 26, 2019**

(54) ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventors: Tomofumi Shimizu, Osaka (JP); Keiji Maruo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/667,690

(22) Filed: Aug. 3, 2017

(65) Prior Publication Data

US 2018/0046098 A1 Feb. 15, 2018

(30) Foreign Application Priority Data

Aug. 10, 2016 (JP) ..... 2016-157137

(51) Int. Cl.

| | |
|---|---|
| ***G03G 5/05*** | (2006.01) |
| ***G03G 5/06*** | (2006.01) |
| *G03G 5/047* | (2006.01) |

(52) U.S. Cl.

CPC ..... *G03G 5/0596* (2013.01); *G03G 5/056* (2013.01); *G03G 5/0609* (2013.01); *G03G 5/0614* (2013.01); *G03G 5/047* (2013.01)

(58) Field of Classification Search

CPC .... G03G 5/0567; G03G 5/0592; G03G 5/056; G03G 5/0596

USPC ..... 430/59.6, 96

See application file for complete search history.

(56) References Cited

U.S. PATENT DOCUMENTS

| | | | | |
|---|---|---|---|---|
| 5,430,526 | A * | 7/1995 | Ohkubo | G03G 15/0233 399/159 |
| 6,649,315 | B1 * | 11/2003 | Takasaki | G03G 9/0819 430/110.3 |
| 7,449,271 | B2 * | 11/2008 | Kobashi | G03G 5/056 430/119.6 |
| 2004/0101771 | A1 * | 5/2004 | Azuma | G03G 5/05 430/58.85 |

FOREIGN PATENT DOCUMENTS

| | | | |
|---|---|---|---|
| JP | 2000-258931 | A * | 9/2000 |
| JP | 2007-121751 | A | 5/2007 |

OTHER PUBLICATIONS

Japanese Patent Office J-PlatPat machine-assisted English-language translation of JP 2000-258931 A (pub. Sep. 2000).*

.Diamond, A.S., ed., Handbook of Imaging Materials, Marcel Dekker, Inc. NY (1991), pp. 427-431. (Year: 1991).*

* cited by examiner

*Primary Examiner* — Janis L Dote

(74) *Attorney, Agent, or Firm* — Studebaker & Brackett PC

(57) ABSTRACT

An electrophotographic photosensitive member includes a conductive substrate and a photosensitive layer. The photosensitive layer is a single layer. The photosensitive layer contains a charge generating material, a hole transport material, an electron transport material, and a binder resin. The photosensitive layer has a scratch resistance depth of no greater than 0.50 μm.

10 Claims, 9 Drawing Sheets

ELECTROPHOTOGRAPHIC PHOTOSENSITIVE MEMBER, PROCESS CARTRIDGE, AND IMAGE FORMING APPARATUS

INCORPORATION BY REFERENCE

The present application claims priority under 35 U.S.C. § 119 to Japanese Patent Application No. 2016-157137, filed on Aug. 10, 2016. The contents of this application are incorporated herein by reference in their entirety.

BACKGROUND

The present disclosure relates to an electrophotographic photosensitive member, a process cartridge, and an image forming apparatus.

An electrophotographic photosensitive member is used in an electrographic image forming apparatus. An example of the electrophotographic photosensitive member is an electrophotographic photosensitive member including a single-layer photosensitive layer. The single-layer photosensitive layer has a charge generation function and a charge transport function.

In an example, the electrophotographic photosensitive member includes a photosensitive layer. An example of a resin contained in the photosensitive layer is a polyarylate resin represented by chemical formula (R-D).

(R-D)

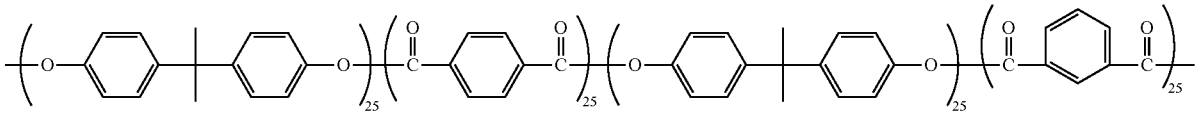

SUMMARY

Figure 1A:
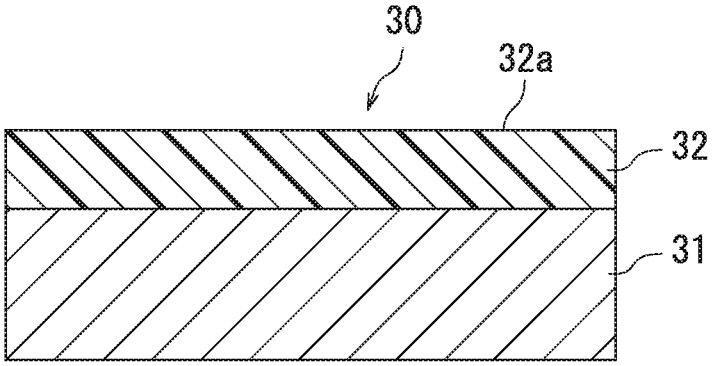
FIGS. 1A and 1B each are a cross-sectional view illustrating an example of a prat of an electrophotographic photosensitive member according to an embodiment of the present disclosure.

An electrophotographic photosensitive member according to the present disclosure includes a conductive substrate and a photosensitive layer as a single layer. The photosensitive layer contains a charge generating material, a hole transport material, an electron transport material, and a binder resin. The photosensitive layer has a scratch resistance depth of no greater than 0.50 μm.

A process cartridge according to the present disclosure includes the above electrophotographic photosensitive member.

An image forming apparatus according to the present disclosure includes the above electrophotographic photosensitive member, a charger, an exposure section, a developing device, and a transfer section. The charger positively charges a surface of the electrophotographic photosensitive member. The exposure section exposes the charged surface of the electrophotographic photosensitive member to form an electrostatic latent image on the surface of the electrophotographic photosensitive member. The developing device develops the electrostatic latent image into a toner image. The transfer section transfers the toner image from the electrophotographic photosensitive member to a recording medium. The electrophotographic photosensitive member is in contact with the recording medium during the transfer section transferring the toner image from the electrophotographic photosensitive member to the recording medium.

DETAILED DESCRIPTION

The following describes an embodiment of the present disclosure in detail. However, the present disclosure is in no way limited to the embodiments below, and various alterations may be made to practice the present disclosure within the scope of the aim of the present disclosure. Although explanation is omitted as appropriate in some instances in order to avoid repetition, such omission does not limit the essence of the present disclosure.

In the present description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof.

Here, an alkyl group having 1 to 6 carbon atoms, an alkoxy group having 1 to 6 carbon atoms, and an alkoxy group having 1 to 4 carbon atoms each refer to the following unless otherwise stated.

The alkyl group having 1 to 6 carbon atoms refers to an unsubstituted straight chain or branched chain alkyl group. Examples of the alkyl group having 1 to 6 carbon atoms include a methyl group, an ethyl group, a propyl group, an isopropyl group, an n-butyl group, a sec-butyl group, a tert-butyl group, a pentyl group, an isopentyl group, a neopentyl group, and a hexyl group.

The alkoxy group having 1 to 6 carbon atoms refers to an unsubstituted straight chain or branched chain alkoxy group. Examples of the alkoxy group having 1 to 6 carbon atoms include a methoxy group, an ethoxy group, an n-propoxy group, an isopropoxy group, an n-butoxy group, a sec-butoxy group, a tert-butoxy group, a pentyloxy group, an isopentyloxy group, a neopentyloxy group, and a hexyloxy group.

<Photosensitive Member>

Figure 1B:
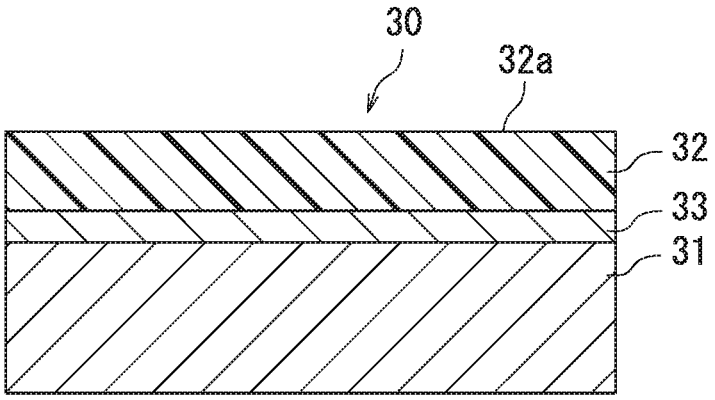

The following describes an electrophotographic photosensitive member (also referred to below simply as a photosensitive member) according to the present embodiment. A configuration of a photosensitive member 30 according to the present embodiment will be described below with reference to FIGS. 1A and 1B. FIGS. 1A and 1B each are a cross-sectional view illustrating an example of a part of the photosensitive member 30 according to the present embodiment.

As illustrated in FIG. 1A, the photosensitive member 30 includes for example a conductive substrate 31 and a photosensitive layer 32. The photosensitive layer 32 is provided as a single layer. The photosensitive member 30 is a so-called single-layer photosensitive member.

As illustrated in FIG. 1B, the photosensitive member 30 may include an intermediate layer 33 (undercoat layer) in addition to the conductive substrate 31 and the photosensitive layer 32. The intermediate layer 33 is disposed between the conductive substrate 31 and the photosensitive layer 32. The photosensitive layer 32 may be disposed directly on the conductive substrate 31, as illustrated in FIG. 1A. Alternatively, the photosensitive layer 32 may be disposed indirectly on the conductive substrate 31 with the intermediate layer 33 therebetween, as illustrated in FIG. 1B.

The photosensitive member 30 may include a protective layer (not illustrated) in addition to the conductive substrate 31 and the photosensitive layer 32. In a configuration in which the photosensitive member 30 includes the protective layer, the protective layer is disposed on the photosensitive layer 32. However, in a configuration in which the photosensitive layer 32 has a specific scratch resistance depth so that occurrence of fogging can be favorably reduced, the photosensitive member 30 preferably include no protective layer. For the same reasons as above, the photosensitive layer 32 preferably serves as a topmost layer of the photosensitive member 30.

No particular limitations are placed on thickness of the photosensitive layer 32 so long as the thickness thereof is sufficient to enable the layer to implement a function thereof. The thickness of the photosensitive layer 32 is preferably at least 5 μm and no greater than 100 μm and more preferably at least 10 μm, and no greater than 50 μm.

The photosensitive layer 32 contains a charge generating material, a hole transport material, an electron transport material, and a binder resin. The photosensitive layer 32 may further contain an additive as needed. The charge generating material, the hole transport material, the electron transport material, the binder resin, and a component added as needed (for example, the additive) are contained in the photosensitive layer 32 as a single layer.

A configuration of the photosensitive member 30 is described so far with reference to FIGS. 1A and 1B. The photosensitive member will be described further in detail below.

(Photosensitive Layer)

The term scratch resistance depth (also referred to below as a scratch depth) of a photosensitive layer refers to a depth of a scratch formed on the photosensitive layer when the photosensitive layer is scratched using specific conditions described below. The scratch depth of a photosensitive layer is measured through performing a first step, a second step, a third step, and a fourth step using a scratching apparatus defined in JIS K5600-5-5. The scratching apparatus includes a fixing table and a scratching stylus. The scratching stylus has a hemi-spherical sapphire tip end having a diameter of 1 mm. In the first step, the photosensitive member is fixed on an upper surface of the fixing table such that a longitudinal direction of the photosensitive member coincides with a longitudinal direction of the fixing table. In the second step, the scratching stylus is brought into perpendicular contact with a surface of the photosensitive layer. In the third step, a scratch is formed on the surface of the photosensitive layer using the scratching stylus in a manner that the fixing table and the photosensitive member fixed on the upper surface of the fixing table are moved by 30 mm in the longitudinal direction of the fixing table at a speed of 30 mm/min. while a load of 10 g is applied to the photosensitive layer through the scratching stylus in perpendicular contact with the surface of the photosensitive layer. In the fourth step, a scratch depth that is a maximum depth of the scratch is measured.

The photosensitive layer of the photosensitive member in the present embodiment has a scratch depth of no greater than 0.50 μm. In a configuration in which the photosensitive layer has a scratch depth of greater than 0.50 μm, fogging may occur in a formed image. The reason therefor is inferred as below. The photosensitive member comes in contact with paper dust or a member of an image forming apparatus in image formation. This forms numerous micro scratches on a surface of a photosensitive layer of the photosensitive member. When toner is caught in the scratches formed on the surface of the photosensitive layer, fogging occurs on a formed image. The photosensitive member in the present embodiment has the photosensitive layer having a scratch depth of no greater than 0.50 μm. In the above configuration, occurrence of fogging can be reduced in a formed image.

The scratch depth of the photosensitive layer is a value indicating a hardness of the photosensitive layer. The photosensitive layer has a hardness corresponding to a scratch depth of no greater than 0.50 μm. That is, the hardness defined by the scratch depth of the photosensitive layer is no greater than 0.50 μm. The phrase "the photosensitive layer has a hardness defined by a scratch depth of no greater than 0.50 μm" means that the photosensitive layer has a hardness where a scratch formed on the photosensitive layer when the photosensitive layer is scratched using the aforementioned specific conditions has a depth of no greater than 0.50 μm.

The scratch depth of the photosensitive layer is preferably at least 0.00 μm and no greater than 0.50 μm, more preferably at least 0.05 μm and no greater than 0.50 μm, and further preferably at least 0.05 μm and no greater than 0.35 μm in order to further reduce occurrence of fogging in a formed image.

The scratch depth of the photosensitive layer can be adjusted for example by changing a material of the binder resin. Alternatively, the scratch depth of the photosensitive layer can be adjusted for example by changing a ratio of a mass of the binder resin relative to a total mass of the photosensitive layer.

(Binder Resin)

The photosensitive layer contains a binder resin. The ratio of the mass of the binder resin relative to the total mass of the photosensitive layer is preferably at least 0.47 and no greater than 0.60, and more preferably at least 0.49 and no greater than 0.59. In a configuration in which the ratio of the mass of the binder resin relative to the total mass of the photosensitive layer is at least 0.47, occurrence of fogging can be further reduced in a formed image. In a configuration in which the ratio of the mass of the binder resin relative to the total mass of the photosensitive layer is no greater than 0.60, electrical characteristics of the photosensitive member (also referred to below simply as sensitivity characteristics) can be improved.

Examples of the binder resin include thermoplastic resins, thermosetting resins, and photocurable resins. Examples of thermoplastic resins include a polycarbonate resin, a polyarylate resin, a styrene-butadiene copolymer, a styrene-acrylonitrile copolymer, a styrene-maleic acid copolymer, an acrylic acid polymer, a styrene-acrylic acid copolymer, a polyethylene resin, an ethylene-vinyl acetate copolymer, a chlorinated polyethylene resin, a polyvinyl chloride resin, a polypropylene resin, an ionomer resin, a vinyl chloride-vinyl acetate copolymer, an alkyd resin, a polyamide resin, a urethane resin, a polysulfone resin, a diallyl phthalate resin, a ketone resin, a polyvinyl butyral resin, a polyester resin, and a polyether resin. Examples of thermosetting resins include a silicone resin, an epoxy resin, a phenolic resin, a urea resin, and a melamine resin. Examples of photocurable resins include epoxy acrylate (an acrylic acid adduct of an epoxy compound) and urethane acrylate (an acrylic adduct of a urethane compound). One of the binder resins listed above may be used or a combination of two or more of the binder resins listed above may be used.

Among the resins listed above, a polyarylate resin represented by the following general formula (1) (also referred to below as polyarylate resin (1)) is preferable in terms of suitable adjustment of the scratch depth of the photosensitive layer to be no greater than 0.50 μm.

(1)

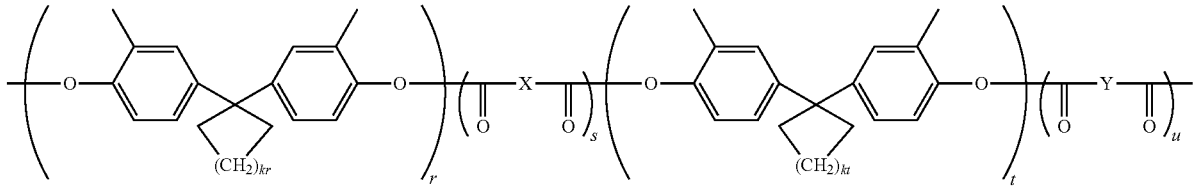

In general formula (1), kr and kt each represent, independently of one another, 2 or 3 and r, s, t, and u each represent, independently of one another, a number of at least 0. Further, r+s+u=100 and r+t=s+u. Yet, s/(s+u) is at least 0.00 and no greater than 0.90. X and Y each represent, independently of one another, a divalent group represented by the following chemical formula (1-1), (1-2), (1-3), (1-4), (1-5), or (1-6). In addition, r/(r+t) is preferably at least 0.00 and no greater than 0.90.

(1-1)

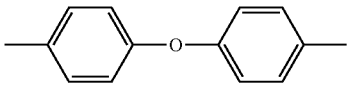

(1-2)

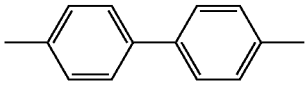

-continued (1-3)

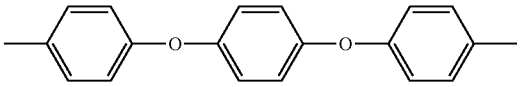

(1-4)

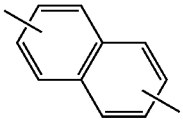

(1-5)

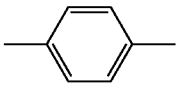

(1-6)

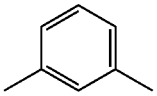

X and Y may be the same or different from each other. Preferably, X and Y are different from each other. Suitable examples of the divalent group represented by chemical formula (1-4) is a divalent group represented by chemical formula (1-7).

(1-7)

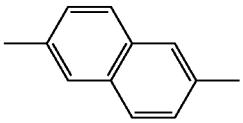

Furthermore, kr and kt may be the same or different from each other. In a configuration in which kr is different from kt, one of kr and kt represents 2 and the other of kr and kt represents 3.

The polyarylate resin (1) includes a repeating unit represented by chemical formula (1-a) (also referred to below as a repeating unit (1-a)), a repeating unit represented by general formula (1-b) (also referred to below as a repeating unit (1-b)), a repeating unit represented by general formula (1-c) (also referred to below as a repeating unit (1-c)), and a repeating unit represented by general formula (1-d) (also referred to below as a repeating unit (1-d)).

(1-a)

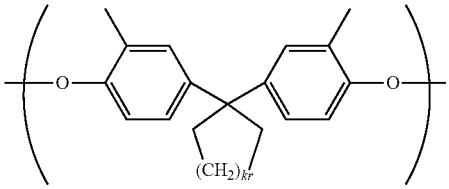

(1-b)

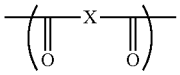

(1-c)

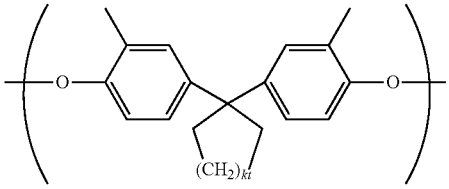

(1-d)

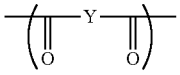

In general formulas (1-a)-(1-d), kr, X, kt, and Y represent the same as kr, X, kt, and Y in general formula (1), respectively.

No particular limitations are placed on arrangement of the repeating units (1-a)-(1-d) in the polyarylate resin (1) as long as a repeating unit derived from an aromatic diol is located adjacent to a repeating unit derived from an aromatic dicarboxylic acid. The repeating unit derived from the aromatic diol includes the repeating units (1-a) and (1-c). The repeating unit derived from the aromatic dicarboxylic acid includes the repeating units (1-b) and (1-d). For example, the repeating unit (1-a) is located adjacent and bonded to the repeating unit (1-b) or (1-d). Also, the repeating unit (1-c) is located adjacent and bonded to the repeating unit (1-b) or (1-d).

In general formula (1), r, s, t, and u each represent, independently of one another, a number (for example, an integer) of at least 0. Preferably, r and s each represent, independently of one another, a number (for example, an integer) of at least 0 and t and u each represent, independently of one another, a number (for example, an integer) of at least 1. Further preferably, r and s each represent, independently of one another, a number (for example, an integer) of at least 0 and no greater than 98 and t and u each represent, independently of one another, a number (for example, an integer) of at least 1 and no greater than 99. Further, r+s+t+u=100. Also, r, s, t, and u each represent a percentage of an amount (number of moles) of corresponding one of the repeating units (1-a), (1-b), (1-c), and (1-d) relative to a total amount (total number of moles) of the repeating units in the polyarylate resin (1). Furthermore, r+t=s+u. Preferably, r and s each represent, independently of one another, a number example, an integer) of at least 0 and no greater than 100. Preferably, t and u each represent, independently of one another, a number example, an integer) of at least 1 and no greater than 100. Preferably, r represents a number (for example, an integer) of at least 0 and no greater than 25 with a number (for example, an integer) of at least 15 and no greater than 25 being more preferable. Preferably, s represents a number (for example, an integer) of at least 0 and no greater than 25 with a number (for example, an integer) of at least 15 and no greater than 25 being more preferable. Preferably, t represents a number (for example, an integer) of at least 25 and no greater than 50 with a number (for example, an integer) of at least 25 and no greater than 35 being more preferable. Preferably, u represents a number (for example, an integer) of at least 25 and no greater than 50 with a number (for example, an integer) of at least 25 and no greater than 35 being more preferable. Subscripts r and s may be the same or different from each other. Furthermore, r and u may be the same or different from each other and t and s may be the same or different from each other. Also t and u may be the same or different from each other and s and u may be the same or different from each other. Preferably, s and u are different from each other.

Furthermore, r/(r+t) represents a ratio of an amount (number of moles) of the repeating unit (1-a) relative to a sum of the respective amounts (numbers of moles) of the repeating units (1-a) and (1-c) in the polyarylate resin (1). Furthermore, s/(s+u) represents a ratio of an amount (number of moles) of the repeating unit (1-b) relative to a sum of the respective amounts (numbers of moles) of the repeating units (1-b) and (1-d) in the polyarylate resin (1).

The ratio r/(r+t) is at least 0.00 and no greater than 0.90. In a configuration in which r/(r+t) is 0.00, r represents 0 and t represents a number (for example, an integer) of at least 1. The ratio r/(r+t) is preferably at least 0.02 and no greater than 0.90, more preferably at least 0.10 and no greater than 0.90, further preferably at least 0.20 and no greater than 0.80, yet further preferably at least 0.30 and no greater than 0.60, and particularly preferably at least 0.30 and no greater than 0.50. It is also preferable that r/(r+t) is 0.00. The ratio s/(s+u) is at least 0.00 and no greater than 0.90. In a configuration in which s/(s+u) is 0.00, s represents 0 and u represents a number (for example, an integer) of at least 1. The ratio s/(s+u) is preferably at least 0.02 and no greater than 0.90, more preferably at least 0.10 and no greater than 0.90 further preferably at least 0.20 and no greater than 0.80, yet further preferably at least 0.30 and no greater than 0.60, and particularly preferably at least 0.30 and no greater than 0.50. It is also preferable that s/(s+u) is 0.00. In a configuration in which the repeating unit (1-a) has the same chemical structure as the repeating unit (1-c), it is preferable that: s/(r+t) and u/(r+t) each are at least 0.00 and no greater than 0.50 and s/u is at least 0.00 and no greater than 1.00.

Suitable examples of polyarylate resin (1) include polyarylate resins represented by respective general formulas (R-i), (R-ii), (R-iv), (R-v), and (R-vii) and polyarylate resins represented by respective chemical formulas (R-3) and (R-6), which will be described later. The polyarylate resins represented by general formulas (R-i), (R-ii), (R-iv), (R-v), and (R-vii) are also referred to below as polyarylate resins (R-i), (R-ii), (R-iv), (R-v), and (R-vii), respectively. In general formula (R-i), $r_1$, $s_1$, $t_1$, and $u_1$ represent the same as r, s, t, and u in general formula (1), respectively. Suitable examples of $r_1$, $s_1$, $t_1$, and $u_1$ in general formula (R-i) are the same as those of r, s, t, and u in general formula (1), respectively. In general formula (R-ii), $r_2$, $s_2$, $t_2$, and $u_2$ represent the same as r, s, t, and u in general formula (1), respectively. Suitable examples of $r_2$, $s_2$, $t_2$, and $u_2$ in general formula (R-ii) are the same as those of r, s, t, and u in general formula (1), respectively. In general formula (R-iv), $r_4$, $s_4$, $t_4$, and $u_4$ represent the same as r, s, t, and u in general formula (1), respectively. Suitable examples of $r_4$, $s_4$, $t_4$, and $u_4$ in general formula (R-iv) are the same as those of r, s, t, and u in general formula (1), respectively. In general formula (R-v), $r_5$, $s_5$, $t_5$, and $u_5$ represent the same as r, s, t, and u in general formula (1), respectively. Suitable examples of $r_5$, $s_5$, $t_5$, and $u_5$ in general formula (R-v) are the same as those of r, s, t, and u in general formula (1), respectively. In general formula (R-vii), $r_7$, $s_7$, $t_7$, and $u_7$ represent the same as r, s, t, and u in general formula (1), respectively. Suitable examples of $r_7$, $r_7$, $s_7$, $t_7$, and $u_7$ in general formula (R-vii) are the same as those of r, s, t, and u in general formula (1), respectively.

(R-i)

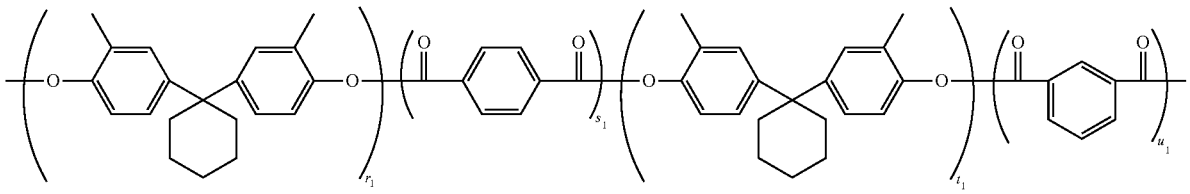

(R-ii)

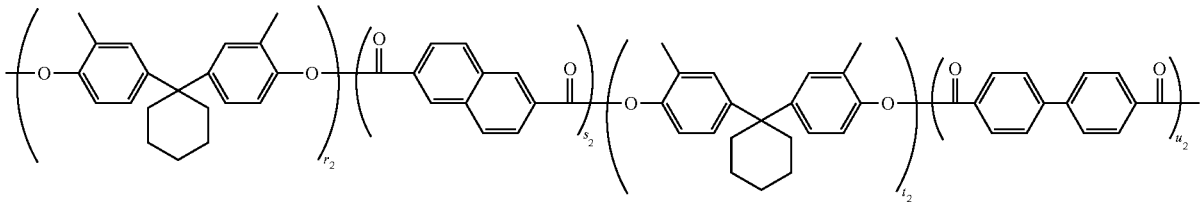

(R-iv)

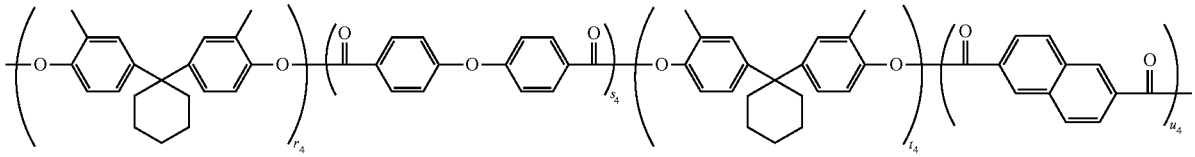

(R-v)

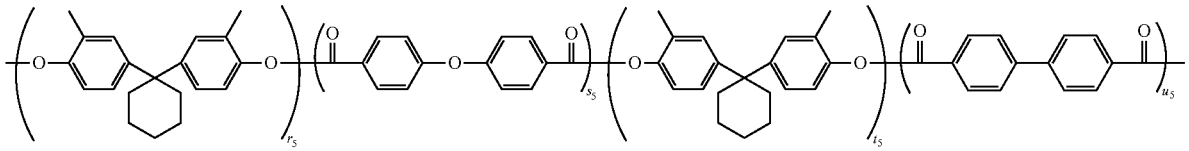

(R-vii)

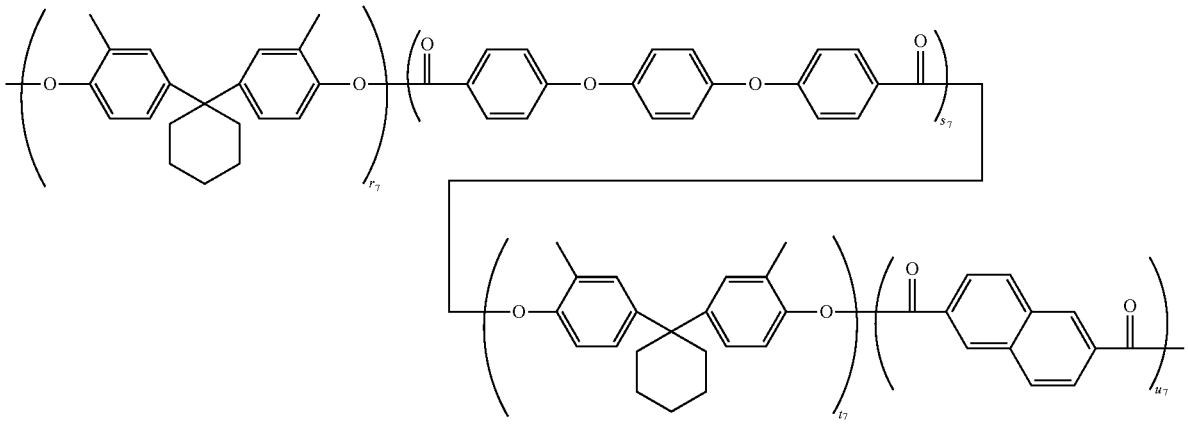

More suitable examples of the polyarylate resin (1) include polyarylate resins represented by respective chemical formulas (R-1), (R-2), (R-3), (R-4), (R-5), (R-6), (R-7), and (R-8). The polyarylate resins represented by respective chemical formulas (R-1), (R-2), (R-3), (R-4), (R-5), (R-6), (R-7), and (R-8) may be also referred to below as polyarylate resins (R-1), (R-2), (R-3), (R-4), (R-5), (R-6), (R-7), and (R-8), respectively.
(R-1)
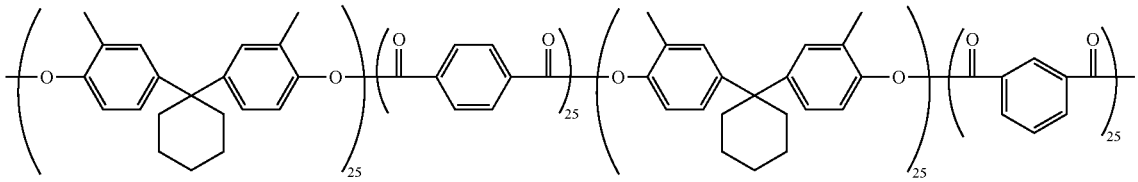
(R-2)
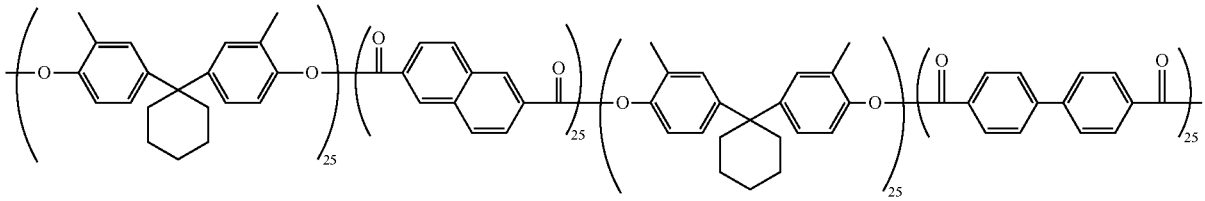
(R-3)
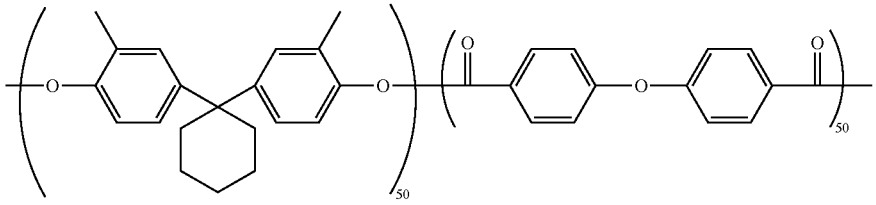
(R-4)
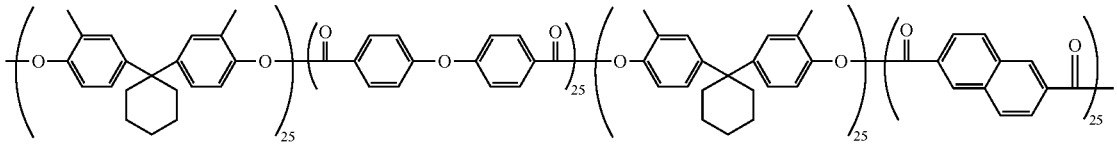
(R-5)
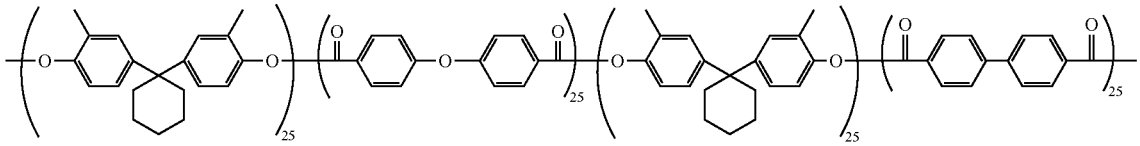
(R-6)
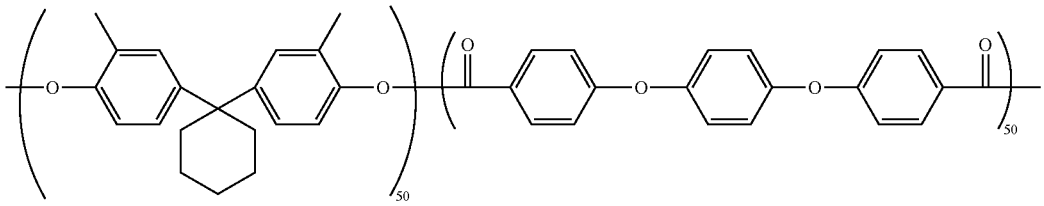

-continued (R-7)

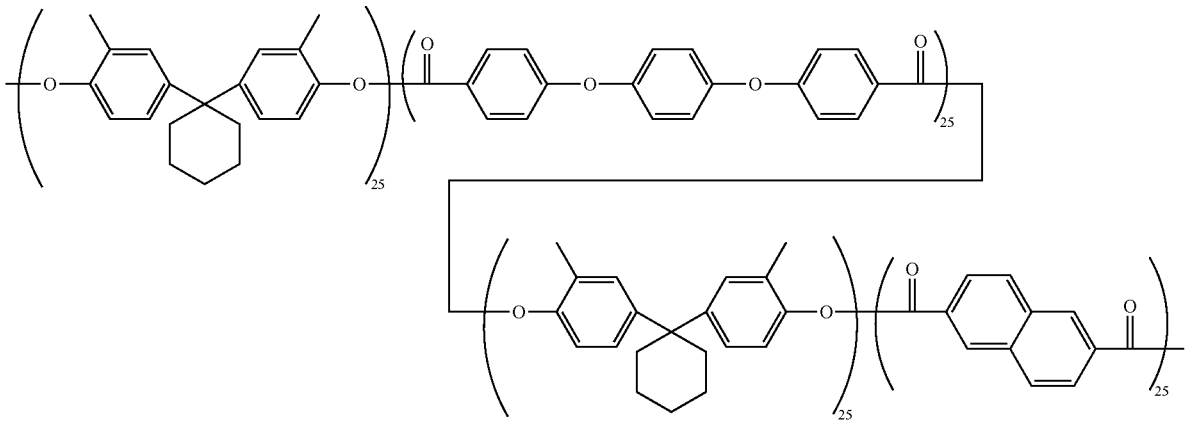

(R-8)

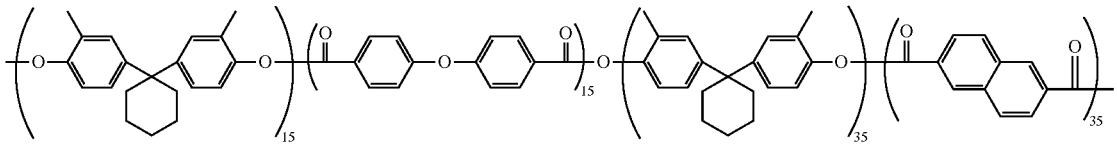

It is preferable that in general formula (1), r, s, t, and u each represent, independently of one another, a number (for example, an integer) of at least 1, s/(s+u) is greater than 0.00 and no greater than 0.90, and one of X and Y represents a divalent group represented by chemical formula (1-1) in order to improve solubility of the polyarylate resin (1) in a solvent for photosensitive layer formation in addition to reduction in occurrence of fogging in a formed image. Suitable examples of such a polyarylate resin include the polyarylate resins (R-4) and (R-5). Note that r/(r+t) may be greater than 0.00 and no greater than 0.90.

It is preferable that in general formula (1), r, s, t, and u each represent, independently of one another, a number (for example, an integer) of at least 1, s/(s+u) is greater than 0.00 and no greater than 0.90, one of X and Y represents the divalent group represented by chemical formula (1-1), and the other of X and Y represents a divalent group represented by chemical formula (1-2) in order to achieve both reduction in occurrence of fogging in a formed image and improvement of sensitivity characteristics of the photosensitive member. A suitable example of such a polyarylate resin is the polyarylate resin (R-5). Note that r/(r+t) may be greater than 0.00 and no greater than 0.90.

It is also preferable that in general formula (1), r and s each represent 0, t and u each represent, independently of one another, a number (for example, an integer) of at least 1, s/(s+u) is 0.00, and Y represents a divalent group represented by chemical formula (1-3) in order to achieve both reduction in occurrence of fogging in a formed image and improvement of sensitivity characteristics of the photosensitive member. In the above configuration, it is further preferable that t and u each represent 50. A suitable example of such a polyarylate resin is the polyarylate resin (R-6). Note that r/(r+t) is 0.00.

It is preferable that in general formula (1), r, s, t, and u each represent, independently of one another, a number (for example, an integer) of at least 1, s/(s+u) is greater than 0.00 and no greater than 0.90, one of X and Y represents the divalent group represented by chemical formula (1-2), and the other of X and Y represents a divalent group represented by chemical formula (1-4) in order to further reduce a scratch depth of the photosensitive layer and further reduce occurrence of fogging in a formed image. A suitable example of such a polyarylate resin is the polyarylate resin (R-2). Note that r/(r+t) may be greater than 0.00 and no greater than 0.90.

It is preferable that in general formula (1), r, s, t, and u each represent, independently of one another, a number (for example, an integer) of at least 1, s/(s+u) is greater than 0.00 and no greater than 0.90, one of X and Y represents the divalent group represented by chemical formula (1-3), and the other of X and Y represents the divalent group represented by chemical formula (1-4) in order to achieve both reduction in occurrence of fogging in a formed image and improvement of sensitivity characteristics of the photosensitive member. A suitable example of such a polyarylate resin is the polyarylate resin (R-7). Note that r/(r+t) may be greater than 0.00 and no greater than 0.90.

It is preferable that in general formula (1), r, s, t, and u each represent, independently of one another, a number example, an integer) of at least 1, s/(s+u) is greater than 0.00 and no greater than 0.90, and s and u represent numbers (for example, integers) different from each other in order to further reduce a scratch depth of the photosensitive layer and further reduce occurrence of fogging in a formed image. For the same purpose as above, it is further preferable that in general formula (1), s/(s+u) greater than 0.00 and no greater than 0.90, s and u represent numbers (for example, integers) different from each other, one of X and Y represents the divalent group represented by chemical formula (1-1), and the other of X and Y represents the divalent group represented by chemical formula (1-4). A suitable example of such a polyarylate resin is the polyarylate resin (R-8). Note that r/(r+t) may be greater than 0.00 and no greater than 0.90.

The polyarylate (1) preferably has a viscosity average molecular weight of at least 10,000, more preferably at least 20,000, and further preferably at least 30,000. In a configuration in which the polyarylate resin (1) has a viscosity average molecular weight of at least 10,000, abrasion resistance of the binder resin increases with a result that the photosensitive layer hardly abrades. By contrast, the binder resin preferably has a viscosity average molecular weight of no greater than 80,000, and more preferably no greater than 51,000. In a configuration in which the binder resin has a viscosity average molecular weight of no greater than 80,000, the polyarylate resin (1) tends to readily dissolve in a solvent for photosensitive layer formation, with a result of easy formation of a photosensitive layer.

No particular limitations are placed on a method for producing the polyarylate resin (1). An example of the method for producing the polyarylate resin (1) is condensation polymerization of aromatic diols and aromatic dicarboxylic acids for forming the repeating units of the polyarylate resin (1). No particular limitations are placed on synthesis of the polyarylate resin (1), and any known synthesis (specific examples include solution polymerization, melt polymerization, and interface polymerization) can be employed.

The aromatic dicarboxylic acids for synthesis of the polyarylate resin (1) are compounds represented by respective general formulas (1-e) and (1-f). X in general formula (1-e) and Y in general formula (1-f) represent the same as X and Y in general formula (1), respectively. The aromatic dicarboxylic acids for synthesis of the polyarylate resin (1) may be each derivatized into an aromatic dicarboxylic acid derivative to be used. Examples of the aromatic dicarboxylic acid derivative include aromatic dicarboxylic acid dichlorides, aromatic dicarboxylic acid dimethyl esters, aromatic dicarboxylic acid diethyl esters, and aromatic dicarboxylic acid anhydrides. An aromatic dicarboxylic acid dichloride has two "—C(═O)—Cl" groups.

(1-e)

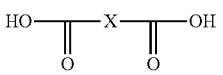

(1-f)

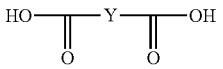

Specific examples of the compounds represented by respective general formulas (1-e) and (1-f), which are the aromatic dicarboxylic acids for synthesis of the polyarylate resin (1), include compounds represented by the following general formulas (1-g)-(1-l). The compounds represented by chemical formulas (1-g)(1-l) may be also referred to below as compounds (1-g)-(1-l), respectively.

(1-g)

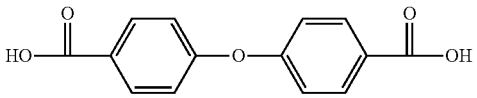

(1-h)

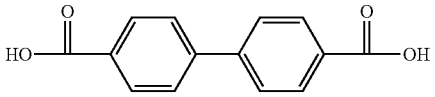

(1-i)

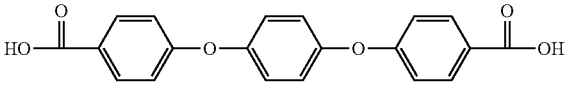

-continued (1-j)

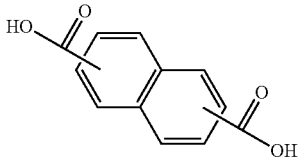

(1-k)

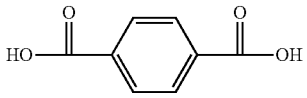

(1-l)

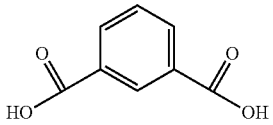

A suitable example of the compound represented by chemical formula (1-j), which is an aromatic dicarboxylic acid for synthesis of the polyarylate resin (1), is a compound represented by the following chemical formula (1-jj). The compound represented by chemical formula (1-jj) may be also referred to below as a compound (1-jj).

(1-jj)

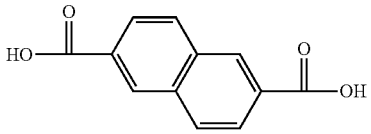

The aromatic dials for synthesis of the polyarylate resin (1) include compounds represented by respective chemical formulas (1-m) and (1-n). Note that kr in general formula (1-m) and kt in general formula (1-n) represent the same as kr and kt in general formula (1), respectively. The aromatic diols for synthesis of the polyarylate resin (1) may be each derivatized to aromatic diacetate for use.

(1-m)

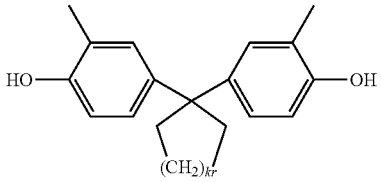

(1-n)

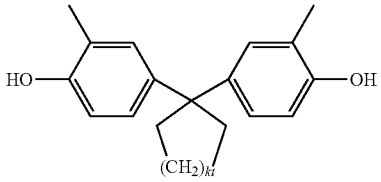

Specific examples of the compounds represented by respective chemical formulas (1-m) and (1-n), which are the aromatic diols for synthesis of the polyarylate resin (1), are compounds represented by respective chemical formulas (1-o) and (1-p). The compounds represented by chemical formulas (1-o) and (1-p) may be also referred to below as compounds (1-o) and (1-p), respectively.

(1-o)

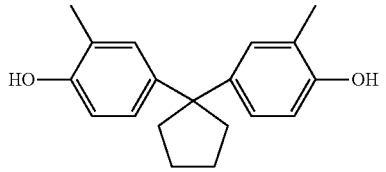

(1-p)

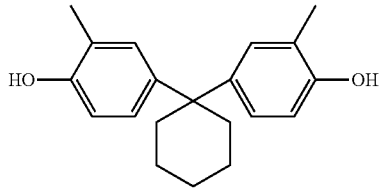

The photosensitive layer may further contain a binder resin other than the polyarylate resin (1) in addition to the polyarylate resin (1). A content of the polyarylate resin (1) is preferably at least 80% by mass relative to a total mass of the binder resin(s), more preferably at least 90% by mass, and particularly preferably 100% by mass.

(Charge Generating Material)

The photosensitive layer contains a charge generating material. No particular limitations are placed on the charge generating material other than being a charge generating material for a photosensitive member. Examples of the charge generating material include phthalocyanine-based pigments, perylene-based pigments, bisazo pigments, trisazo pigments, dithioketopyrrolopyrrole pigments, metal-free naphthalocyanine pigments, metal naphthalocyanine pigments, squaraine pigments, indigo pigments, azulenium pigments, cyanine pigments, powders of inorganic photoconductive materials (examples include selenium, selenium-tellurium, selenium-arsenic, cadmium sulfide, and amorphous silicon), pyrylium pigments, anthanthrone-based pigments, triphenylmethane-based pigments, threne-based pigments, toluidine-based pigments, pyrazoline-based pigments, and quinacridon-based pigments. One of the charge generating materials listed above may be used or a combination of two or more of the charge generating materials listed above may be used.

Examples of phthalocyanine-based pigments include a metal-free phthalocyanine represented by chemical formula (CGM-1) and metal phthalocyanines. Examples of metal phthalocyanines include titanyl phthalocyanine represented by chemical formula (CGM-2), hydroxygallium phthalocyanine, and chlorogallium phthalocyanine. A crystalline or non-crystalline phthalocyanine-based pigment may be used. No particular limitations are placed on crystal structure of the phthalocyanine-based pigments (examples include α-form, β-form, Y-form, V-form, and II-form), and a phthalocyanine-based pigment having any crystal structure can be used.

(CGM-1)

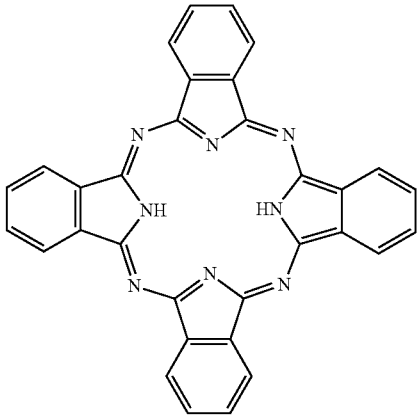

(CGM-2)

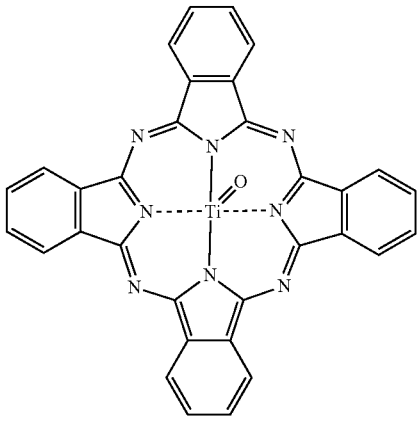

An example of crystal of metal-free phthalocyanines is X-form crystal of a metal-free phthalocyanine (also referred to below as X-form metal-free phthalocyanine). Examples of crystal of titanyl phthalocyanine include α-form, β-form, and Y-form crystal of titanyl phthalocyanine (also referred to below as α-form, β-form, and Y-form titanyl phthalocyanines, respectively). An example of crystal of hydroxygallium phthalocyanine is V-form crystal of hydroxygallium phthalocyanine.

For example, a photosensitive member having sensitivity in a wavelength range of at least 700 nm is preferably used in a digital optical image forming apparatus (for example, a laser beam printer or facsimile machine with a light source such as a semiconductor laser). In terms of high quantum yield in a wavelength range of at least 700 nm, a phthalocyanine-based pigment is preferable as the charge generating material and a metal-free phthalocyanine or titanyl phthalocyanine is more preferable, with an X-form metal-free phthalocyanine or Y-form titanyl phthalocyanine being further preferable. In order to particularly improve sensitivity characteristics in a configuration in which the photosensitive layer contains the compound (1) as a hole transport material, Y-form titanyl phthalocyanine is further preferable as a charge generating material.

An anthanthrone-based pigment is preferably used as a charge generating material of a photosensitive member adopted in an image forming apparatus including a short-wavelength laser light source (for example, a laser light source having a wavelength of at least 350 nm and no greater than 550 nm).

The content of the charge generating material is preferably at least 0.1 parts by mass and no greater than 50 parts by mass relative to 100 parts by mass of the binder resin contained in the photosensitive layer, more preferably at least 0.5 parts by mass and no greater than 30 parts by mass, and particular preferably at least 0.5 parts by mass and no greater than 4.5 parts by mass.

(Electron Transport Material)

The photosensitive layer contains an electron transport material. Examples of the electron transport material include quinone-based compounds, diimide-based compounds, hydrazone-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of quinone-based compounds include a diphenoquinone-based compound, an azoquinone-based compound, an anthraquinone-based compound, a naphthoquinone-based compound, a nitoanthraquinone-based compound, and a dinitroanthraquinone-based compound. One of the electron transport materials listed above may be used or a combination of two or more of the electron transport materials listed above may be used.

A compound represented by general formula (ETM1) is preferably use as the electron transport material in order to reduce occurrence of fogging in a formed image. The compound represented by general formula (ETM1) has a comparatively small molecular weight. It can be therefore considered that the compound represented by general formula (ETM1) fills micro gaps in the binder resin with a result that a photosensitive layer having a small scratch depth can be formed.

(ETM1)

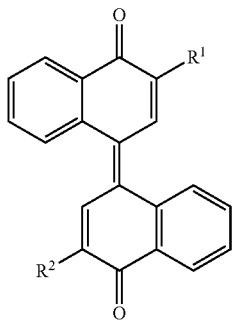

In general formula (ETM1), $R^1$ and $R^2$ each represent, independently of one another, an alkyl group having 1 to 6 carbon atoms.

A suitable example of the compound represented by general formula (ETM1) is a compound represented by chemical formula (ETM1-1) (also referred to below as a compound (ETM1-1)).

(ETM1-1)

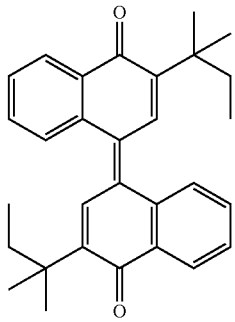

The content of the compound represented by general formula (ETM1) is preferably at least 80% by mass relative to a total mass of the electron transport material(s), more preferably at least 90% by mass, and particularly preferably 100% by mass.

The content of the electron transport material contained in the photosensitive layer is preferably at least 5 parts by mass and no greater than 100 parts by mass relative to 100 parts by mass of the binder resin, and more preferably at least 10 parts by mass and no greater than 80 parts by mass.

(Hole Transport Material)

The photosensitive layer contains a hole transport material. Examples of the hole transport material include triphenylamine derivatives, diamine derivatives (examples include an N,N,N',N'-tetraphenylbenzidine derivative, an N,N,N',N'-tetraphenylphenylenediamine derivative, an N,N,N',N'-tetraphenylnaphtylenediamine derivative, an N,N,N',N'-tetraphenylphenanthrylenediamine derivative, and a di(aminophenylethenyl)benzidine derivative), oxadiazole-based compounds (for example, 2,5-di(4-methylaminophenyl)-1,3,4-oxadiazole), styryl-based compounds (for example, 9-(4-diethylaminostyryl)anthracene), carbazole-based compounds (for example, polyvinyl carbazole), organic polysilane compounds, pyrazoline-based compounds (for example, 1-phenyl-3-(p-dimethylaminophenyl) pyrazoline), hydrazone-based compounds, indole-based compounds, oxazole-based compounds, isoxazole-based compounds, triazole-based compounds, thiadiazole-based compounds, imidazole-based compounds, pyrazole-based compounds, and triazole-based compounds. One of the hole transport materials listed above may be used or a combination of two or more of the hole transport materials listed above may be used.

A compound represented by general formula (HTM1) is preferably used as the hole transport material in order to reduce occurrence of fogging in a formed image. The compound represented by general formula (HTM1) has a comparatively small molecular weight. It can be therefore considered that the compound represented by general formula (HTM1) fills micro gaps in the binder resin with a result that a photosensitive layer having a small scratch depth can be formed.

(HTM1)

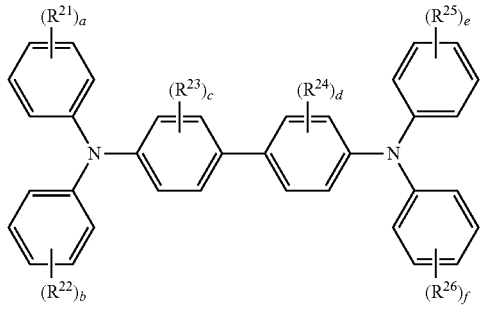

In general formula (HTM1), $R^{21}$, $R^{22}$, $R^{23}$, $R^{24}$, $R^{25}$, and $R^{26}$ each represent, independently of one another, an alkyl group having 1 to 6 carbon atoms or an alkoxy group having 1 to 6 carbon atoms. Furthermore, a, b, e, and f each represent, independently of one another, an integer of at least 0 and no greater than 5 and c and d each represent, independently of one another, an integer of at least 0 and no greater than 4.

In general formula (HTM1), preferably, $R^{21}$-$R^{26}$ each represent, independently of one another, an alkyl group having 1 to 6 carbon atoms with a methyl group being more preferable. Preferably, a, b, e, and f each represent, independently of one another, 0 or 1. Preferably, c and d each represent, independently of one another, 0 or 1 with 0 being more preferable.

A suitable example of the compound represented by general formula (HTM1) is a compound represented by chemical formula (HTM1-1) (also referred to below as a compound (HTM1-1)).

(HTM1-1)

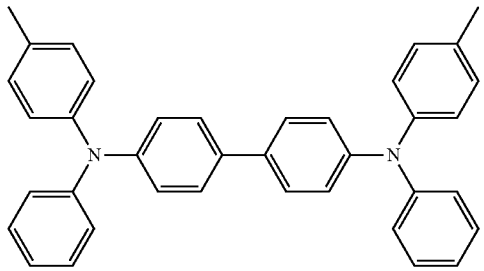

The content of the compound represented by general formula (HTM1) is preferably at least 80% by mass relative to a total mass of the hole transport material(s), more preferably at least 90% by mass, and particularly preferably 100% by mass.

The content of the hole transport material contained in the photosensitive layer is preferably at least 10 parts by mass and no greater than 200 parts by mass relative to 100 parts by mass of the binder resin, and more preferably at least 10 parts by mass and no greater than 100 parts by mass.

(Additive)

The photosensitive layer may optionally contain an additive as needed. Examples of the additive include antidegradants (examples include an antioxidant, a radical scavenger, a singlet quencher, and a ultraviolet absorbing agent), softeners, surface modifiers, extenders, thickeners, dispersion stabilizers, waxes, acceptors, donors, surfactants, plasticizers, sensitizers, and leveling agents. Examples of antioxidants include hindered phenol (for example, di(tert-butyl)p-cresol), hindered amine, paraphenylenediamine, arylalkane, hydroquinone, spirochromane, spiroindanone, derivatives of the compounds above listed, organosulfur compounds, and organophosphorous compounds.

(Conductive Substrate)

No particular limitations are placed on the conductive substrate other than being adoptable as a conductive substrate of a photosensitive member. It is only required that at least a surface portion of the conductive substrate is made from a conductive material. An example of the conductive substrate is a conductive substrate made from a conductive material. Another example of the conductive substrate is a substrate covered with a conductive material. Examples of the conductive material include aluminum, iron, copper, tin, platinum, silver, vanadium, molybdenum, chromium, cadmium, titanium, nickel, palladium, indium, stainless steel, and brass. One of the conductive materials listed above may be used or a combination of two or more of the conductive materials listed above may be used (as an alloy, for example). In terms of excellent mobility of electrical charge from the photosensitive layer to the conductive substrate, aluminum or an aluminum alloy is preferable among the conductive materials listed above.

Shape of the conductive substrate is appropriately selected according to a configuration of an image forming apparatus. Examples of the shape of the conductive substrate include a sheet-like shape and a drum-like shape. Thickness of the conductive substrate is also appropriately selected according to the shape of the conductive substrate.

(Intermediate Layer)

The intermediate layer (undercoat layer) contains for example inorganic particles and a resin for intermediate layer use (intermediate layer resin). It is considered that in the presence of the intermediate layer, electric current generated at exposure of the photosensitive member can smoothly flow while an insulation state to an extent that occurrence of leakage current can be reduced is maintained, thereby suppressing an increase in electric resistance.

Examples of the inorganic particles include particles of metals (examples include aluminum, iron, and copper), particles of metal oxides (examples include titanium oxide, alumina, zirconium oxide, tin oxide, and zinc oxide), and particles of non-metal oxides (for example, silica). One type of the organic particles listed above may be used or a combination of two or more types of the inorganic particles listed above may be used.

No particular limitations are placed on the intermediate layer resin other than being usable as a resin for forming an intermediate layer. The intermediate layer may contain an additive. Examples of the additive are the same as those of the additive of the photosensitive layer.

(Photosensitive Member Producing Method)

The following describes an example of a photosensitive member producing method. The photosensitive member is produced by applying an application liquid for photosensitive layer formation to a conductive substrate and drying the application liquid. The application liquid for photosensitive layer formation is produced by dissolving or dispersing the charge generating material, the hole transport material, the electron transport material, the binder resin, and a component added as needed (for example, an additive) in a solvent.

No particular limitations are placed on the solvent contained in the application liquid for photosensitive layer formation other than a solvent that can dissolve or disperse the respective components contained in the application liquid. Examples of the solvent include alcohols (examples include methanol, ethanol, isopropanol, and butanol), aliphatic hydrocarbons (examples include n-hexane, octane, and cyclohexane), aromatic hydrocarbons (examples include benzene, toluene, and xylene), halogenated hydrocarbons (examples include dichloromethane, dichloroethane, carbon tetrachloride, and chlorobenzene) ethers (examples include dimethyl ether, diethyl ether, tetrahydrofuran, ethylene glycol dimethyl ether, diethylene glycol dimethyl ether, and propylene glycol monomethyl ether), ketones (examples include acetone, methyl ethyl ketone, and cyclohexanone), esters (examples include ethyl acetate and methyl acetate), dimethyl formaldehyde, dimethyl formamide, and dimethyl sulfoxide. One of the solvents listed above may be used or a combination of two or more of the solvents listed above may be used. A non-halogen solvent (solvent other than halogenated hydrocarbon) is preferably used as the solvent in order to improve workability in production of the photosensitive member.

The application liquid is prepared by mixing the respective components and dispersing the components in the solvent. The components can be mixed or dispersed using a bead mill, a roll mill, a ball mill, an attritor, a paint shaker, or a ultrasonic disperser.

The application liquid for photosensitive layer formation may contain for example a surfactant in order to improve dispersibility of the respective components.

No particular limitations are placed on a method for applying the application liquid for photosensitive layer formation as long as uniform application of the application liquid for photosensitive layer formation on a conductive substrate can be achieved. Examples of the application method include dip coating, spray coating, spin coating, and bar coating.

No particular limitations are placed on a method for drying the application liquid for photosensitive layer formation as long as the solvent in the application liquid can be evaporated. An example of the method is a heat treatment (hot-air drying) using a high-temperature dryer or a reduced pressure dryer. Conditions of the heat treatment include for example a temperature of at least 40° C. and no greater than 150° and a time period of at least three minutes and no greater than 120 minutes.

The photosensitive member producing method may further include either or both of intermediate layer formation and protective layer formation as necessary. Respective known methods are appropriately selected for the intermediate layer formation and the protective layer formation.

<Image Forming Apparatus>

Figure 2:
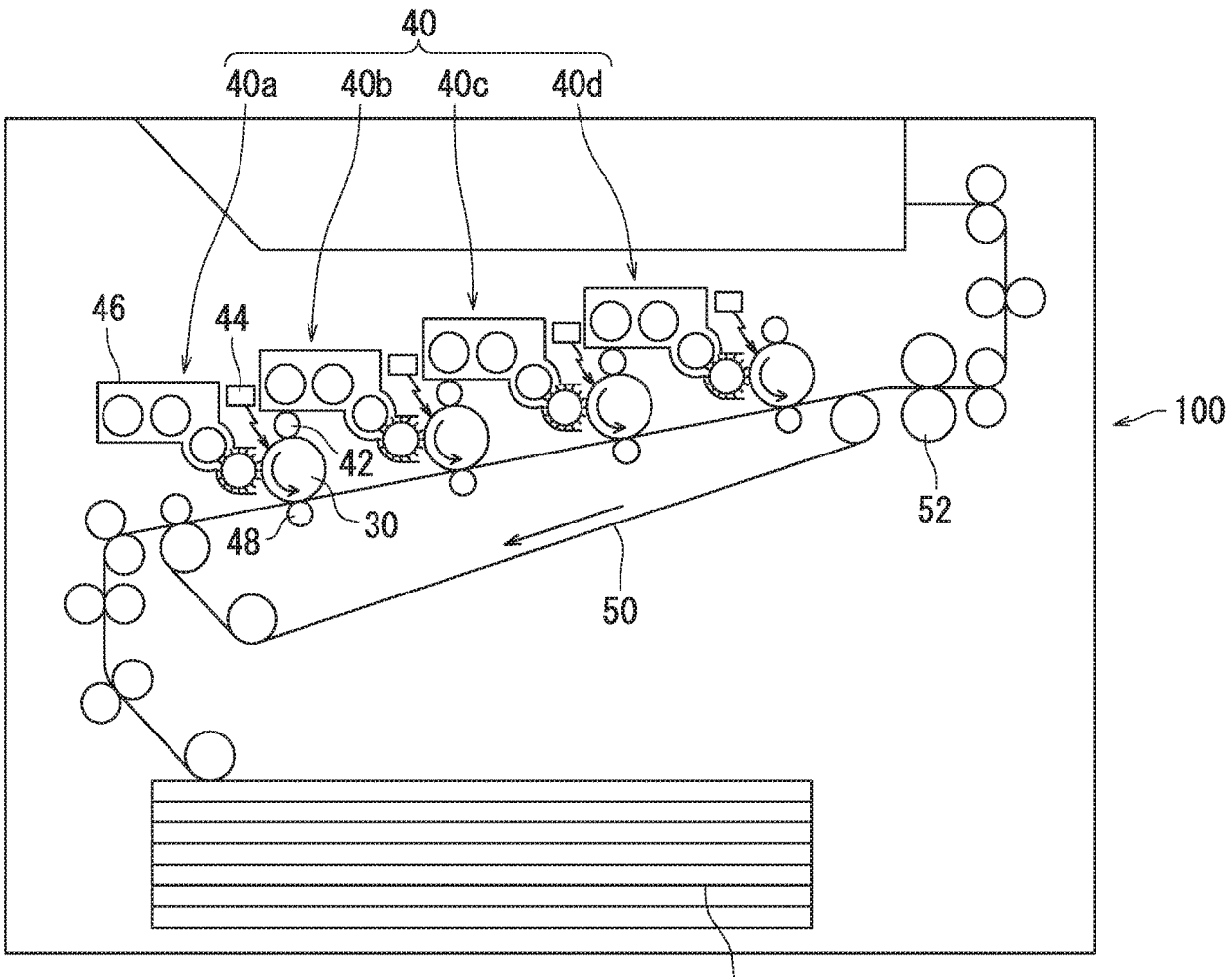
FIG. 2 illustrates an example of a configuration of an image forming apparatus that includes the electrophotographic photosensitive member according to the embodiment of the present disclosure.

The following describes an image forming apparatus 100 including the photosensitive member 30 according to the present embodiment with reference to FIG. 2. FIG. 2 illustrates an example of a configuration of the image forming apparatus 100.

No particular limitations are placed on the image forming apparatus 100 other than being an electrographic image forming apparatus. The image forming apparatus 100 may be a monochrome image forming apparatus or a color image forming apparatus, for example. In a configuration in which the image forming apparatus 100 is a color image forming apparatus, the image forming apparatus 100 is for example a tandem image forming apparatus. A tandem image forming apparatus will be described below as an example of the image forming apparatus 100.

The image forming apparatus 100 includes image forming units 40*a*, 40*h*, 40*c*, and 40*d*, a transfer belt 50, and a fixing section 52. Each of the image forming units 40*a*, 40*b*, 40*c*, and 40*d* is referred below to as an image forming unit 40 where it is not necessary to distinguish among the image forming units 40*a*-40*d*. In a configuration in which the image forming apparatus 100 is a monochrome image forming apparatus, the image forming apparatus 100 includes only the image forming unit 40*a* and the image forming units 40*b*-40*d* are omitted.

The image forming unit 40 includes the photosensitive member 30, a charger 42, an exposure section 44, a developing device 46, and a transfer section 48. The photosensitive member 30 is disposed at a central part of the image forming unit 40. The photosensitive member 30 is rotatable in an arrowed direction (anticlockwise) in FIG. 2. The charger 42, the exposure section 44, the developing device 46, and the transfer section 48 are disposed around the photosensitive member 30 in stated order starting from the charger 42 from upstream to downstream in a rotational direction of the photosensitive member 30. The image forming unit 40 may further include either or both of a cleaner (not illustrated) and a static eliminator (not illustrated).

The charger 42 positively charges a surface (circumferential surface) of the photosensitive member 30. In a configuration in which the photosensitive member 30 includes no protective layer, the surface of the photosensitive member 30 corresponds to a surface 32*a* of the photosensitive layer 32. The charger 42 is a non-contact or contact charger. Examples of a non-contact charger 42 include a corotron charger and a scorotron charger. Examples of a contact charger 42 include a charging roller and a charging brush.

The image forming apparatus 100 is capable of including a charging roller as the charger 42. The charging roller charges the surface of the photosensitive member 30 while in contact with the photosensitive member 30. Usually, contact between a charging roller and a photosensitive member may form scratches on the surface of the photosensitive member. Further, usually, contact between the charging roller and the photosensitive member may cause toner to be caught in the scratches on the surface of the photosensitive member. As a result of them, fogging may occur in a formed image. In view of the foregoing, the image forming apparatus 100 includes the photosensitive member 30. In a configuration with the photosensitive member 30, occurrence of fogging can be reduced in a formed image, as described above. For the reason as above, occurrence of fogging can be reduced in an image formed using the image forming apparatus 100 even including a charging roller as the charger 42.

The exposure section 44 exposes the charged surface of the photosensitive member 30. Exposure forms an electrostatic latent image on the surface of the photosensitive member 30. The electrostatic latent image is formed based on image data input to the image forming apparatus 100.

The developing device 46 supplies toner to the electrostatic latent image formed on the photosensitive member 30. Toner supply causes the electrostatic latent image to be developed into a toner image. The photosensitive member 30 corresponds to an image bearing member bearing the toner image. The toner may be used as a one-component developer. Alternatively, the toner may be mixed with a desired carrier to be used for a two-component developer. In a situation in which the toner is used as a one-component developer, the developing device 46 supplies the toner that is the one-component developer to the electrostatic latent image formed on the photosensitive member 30. In a situation in which the toner is used for the two-component developer, the developing device 46 supplies the toner of the two-component developer containing the toner and the carrier to the electrostatic latent image formed on the photosensitive member 30.

The developing device 46 is capable of developing an electrostatic latent image into a toner image while in contact with the surface of the photosensitive member 30. That is, a so-called contact development can be adopted to the image forming apparatus 100. Usually, contact between a developing device and a photosensitive member may form scratches on the surface of the photosensitive member. Further, usually, contact between the developing device and the photosensitive member may also cause toner to be caught in the scratches on the surface of the photosensitive member. As a result of them, fogging may occur in image formation. In view of the foregoing, the image forming apparatus 100 includes the photosensitive member 30. Occurrence of fogging can be reduced in a formed image in a configuration with the photosensitive member 30, as described above. For the reason as above, occurrence of fogging can be reduced in an image formed using the image forming apparatus 100 even including the developing device 46 that performs contact development.

The developing device 46 is capable of cleaning the surface of the photosensitive member 30. That is, a cleaning method using no cleaner can be adopted to the image forming apparatus 100. The developing device 46 can remove components remaining on the surface of the photosensitive member 30 (also referred to below as "residual components"). Examples of the residual components include toner components and more specifically, toner or an external additive that separates from the toner. Another example of the residual components is non-toner components and more specifically micro components of the recording medium M (for example, paper dust). In the image forming apparatus 100 to which the cleaning method using no cleaner is adopted, such residual components on the surface of the photosensitive member 30 are not scraped by a cleaner (for example, a cleaning blade). For the reason as above, the residual components usually tends to remain on the surface of a photosensitive member in an image forming apparatus to which the cleaning method using no cleaner is adopted and accordingly tend to scratch the surface of the photosensitive member. Furthermore, usually, the residual components may be caught in the scratches on the surface of the photosensitive member. As a result of them, fogging may occur in a formed image. In view of the foregoing, the image forming apparatus 100 includes the photosensitive member 30. Occurrence of fogging can be reduced in a formed image in a configuration with the photosensitive member 30, as described above. For the reason as above, occurrence of fogging can be reduced in an image formed using the image forming apparatus 100 even including no cleaner.

Preferably, the following Conditions (a) and (b) are satisfied in order that the developing device 46 efficiently cleans the surface of the photosensitive member 30.

Condition (a): Development is performed by contact development and peripheral speeds (rotational speed) are differentiated between the photosensitive member 30 and the developing device 46.

Condition (b): The surface potential of the photosensitive member 30 and the potential of a developing bias satisfy the following inequalities (b-1) and (b-2).

0 (V)<Potential (V) of developing bias<Surface potential (V) of unexposed region of photosensitive member 30 (b-1)

Potential (V) of developing bias>Surface potential (V) of exposed region of Photosensitive member 30>0 (V) (b-2)

In a configuration in which contact development is performed and the peripheral speeds are differentiated between the photosensitive member 30 and the developing device 46, as described in Condition (a), the surface of the photosensitive member 30 comes in contact with the developing device 46 to cause friction with the developing device 46, thereby removing components adhering to the surface of the photosensitive member 30. The peripheral speed of the developing device 46 is preferably higher than that of the photosensitive member 30.

Condition (b) assumes reversal development as a development scheme. It is preferable that the charging polarity of the toner, the respective surface potentials of an unexposed region and an exposed region of the photosensitive member 30, and the potential of the developing bias are all positive. The surface potentials of the unexposed and exposed regions of the photosensitive member 30 are measured after the transfer section 48 transfers the toner image from the photosensitive member 30 to the recording medium M through a rotation of the photosensitive member 30 for image formation and before the charger 42 charges the surface of the photosensitive member 30 for the next rotation of the photosensitive member 30.

When inequality (b-1) in Condition (b) is satisfied, static repulsion acting between toner remaining on the photosensitive member 30 (also referred to below as residual toner) and the unexposed region of the photosensitive member 30 is larger than static repulsion acting between the residual toner and the developing device 46. For the reason as above, the residual toner on the unexposed region of the photosensitive member 30 moves from the surface of the photosensitive member 30 to the developing device 46 to be collected.

When inequality (b-2) in Condition (b) is satisfied, static repulsion acting between the residual toner and the exposed region of the photosensitive member 30 is smaller than the static repulsion acting between the residual toner and the developing device 46. For the reason as above, the residual toner on the exposed region of the photosensitive member 30 is held on the surface of the photosensitive member 30. The toner held on the exposed region of the photosensitive member 30 is directly used for image formation.

The transfer belt 50 conveys the recording medium M between the photosensitive member 30 and the transfer section 48. The transfer belt 50 is an endless belt. The transfer belt 50 is rotatable in an arrowed direction (clockwise) in FIG. 2.

The transfer section 48 transfers the toner image developed by the developing device 46 from the photosensitive member 30 to the recording medium M. An example of the transfer section 48 is a transfer roller. The photosensitive member 30 is in contact with the recording medium M during the toner image being transferred from the photosensitive member 30 to the recording medium M. During the time when the toner image is transferred from the photosensitive member 30 to the recording medium M, the recording medium M is located on the transfer belt 50 that is located on the transfer section 48 and the photosensitive member 30 is located on the recording medium M. That is, a so-called direct transfer process is adopted to the image forming apparatus 100. In an image forming apparatus to which the direct transfer process is adopted, usually, contact between a recording medium and a photosensitive member may form scratches on the surface of the photosensitive member. Further, usually, contact between the recording medium and the photosensitive member also causes micro components of the recording medium (for example, paper dust) to adhere to the surface of the photosensitive member. The adhering micro components may form scratches on the surface of the photosensitive member. As a result of them, fogging may occur in a formed image. In view of the foregoing, the image forming apparatus 100 includes the photosensitive member 30. Occurrence of fogging can be reduced in a formed image in a configuration with the photosensitive member 30, as described above. For the reason as above, occurrence of fogging can be reduced in an image formed using the image forming apparatus 100 even including the transfer section 48 that performs transfer by the direct transfer process.

Toner images in plural colors (for example, four colors of black, cyan, magenta, and yellow) are sequentially superposed one on the other on the recording medium M placed on the transfer belt 50 by the image forming units 40*a* to 40*d*.

The fixing section 52 applies either or both of heat and pressure to an unfixed toner image transferred to the recording medium M by the transfer section 48. The fixing section 52 includes for example either or both of a heating roller and a pressure roller. Application of either or both of heat and pressure to the toner image fixes the toner image to the recording medium M. As a result, an image is formed on the recording medium M.

<Process Cartridge>

A process cartridge including the photosensitive member 30 of the present embodiment will be described next with reference to FIG. 2. The process cartridge is a cartridge for image formation. The process cartridge corresponds to each of the image forming units 40*a*-40*d*. The process cartridge includes the photosensitive member 30. The process cartridge includes at least one selected from the group consisting of the charger 42, the exposure section 44, the developing device 46, and the transfer section 48 in addition to the photosensitive member 30. The process cartridge may further include either or both a cleaner (not illustrated) and a static eliminator (not illustrated). The process cartridge is designed to be attachable to and detachable from the image forming apparatus 100. In the above configuration, the process cartridge can be easily handled. As a result, easy and speedy replacement of the process cartridge including the photosensitive member 30 can be achieved in a situation in which sensitivity characteristics or the like of the photosensitive member 30 are degraded.

EXAMPLES

The following provides more specific explanation of the present disclosure through examples. However, the present disclosure is not in any way limited to the scope of the examples.

A charge generating material, a hole transport material, an electron transport material, and binder resins described below were prepared as materials for forming photosensitive layers of respective photosensitive members.

(Charge Generating Material)

X-form metal-free phthalocyanine was prepared as the charge generating material. The X-form metal-free phthalocyanine was the metal-free phthalocyanine represented by chemical formula (CGM-1) discussed in the embodiment. The crystal structure of the X-form metal-free phthalocyanine was X-from.

(Hole Transport Material)

The compound (HTM1-1) discussed in the embodiment was prepared as the hole transport material.

(Electron Transport Material)

The compound (ETMT1-1) discussed in the embodiment was prepared as the electron transport material.

(Binder Resin)

The polyarylate resins (R-1)-(R-8) discussed in the embodiment were each produced as a binder resin.

[Production of Polyarylate Resin (R-2)]

A three-necked flask was used as a reaction vessel. The reaction vessel was a 1-L three-necked flask equipped with a thermometer, a three-way cock, and a 200-mL dripping funnel. To the reaction vessel, 12.24 g (41.28 millimoles) of 1,1-bis(4-hydroxy-3-methylphenyl)cyclohexane (the compound (1-p) discussed in the embodiment), 0.062 g (0.413 millimoles) of tert-butylphenol, 3.92 g (98 millimoles) of sodium hydroxide, and 0.120 g (0.384 millimoles) of benzyltrimethylammonium chloride were added. The reaction vessel was then purged with argon. Thereafter, 300 mL of water was further added to the reaction vessel. The internal temperature of the reaction vessel was raised to 50° C. The contents of the reaction vessel were stirred for one hour while the internal temperature of the reaction vessel was kept at 50° C. The internal temperature of the reaction vessel was then cooled to 10° C. As a result, an alkaline aqueous solution was yielded.

Separately, 4.10 g (16.2 millimoles) of 2,6-naphthalene dicarboxylic acid dichloride (a dicarboxylic acid dichloride of the compound (1-jj) discussed in the embodiment) and 4.52 g (16.2 millimoles) of biphenyl-4,4'-dicarboxylic acid dichloride (a dicarboxylic acid dichloride of the compound (1-h) discussed in the embodiment) were dissolved in 150 mL of chloroform. As a result, a chloroform solution was yielded.

Next, the chloroform solution was dripped into the alkaline aqueous solution little by little over 110 minutes using a dripping funnel to initiate polymerization reaction. The polymerization reaction was allowed to progress in a manner that the contents of the reaction vessel was stirred for four hours while the internal temperature of the reaction vessel was kept at 15±5° C.

Thereafter, an upper layer (water layer) of the contents of the reaction vessel was removed using a decant, thereby obtaining an organic layer. Subsequently, 400 mL of ion exchanged water was added to a 1-L three-necked flask and the obtained organic layer was added thereto. Furthermore, 400 mL of chloroform and 2 mL of acetic acid were added thereto. The contents of the three-necked flask were stirred for 30 minutes at room temperature (25° C.). Thereafter, an upper layer (water layer) of the contents of the three-necked flask was removed using a decant, thereby obtaining an organic layer. The obtained organic layer was washed five times with 1 L of water using a separating funnel. As a result, a washed organic layer was obtained.

The washed organic layer was filtered to yield a filtrate. Then, 1 L of methanol was added to a 1-L Erlenmeyer flask. The yielded filtrate was dripped into the Erlenmeyer flask little by little to yield a precipitate. The precipitate was separated by filtration. The yielded precipitate was vacuum-dried for 12 hours at a temperature of 70° C. As a result, the polyarylate resin (R-2) was produced. The mass yield of the polyarylate resin (R-2) was 12.2 g, and the percentage yield thereof was 77 mol %. The polyarylate resin (R-2) had a viscosity average molecular weight of 46,000.

[Production of Polyarylate Resin (R-1) and (R-3)-(R-8)]

The polyarylate resins (R-1) and (R-3)-(R-8) were produced according to the same method as for the polyarylate resin (R-2) in all aspects except the following changes.

For producing the polyarylate resin (R-1), 2,6-naphthalene dicarboxylic acid dichloride (16.2 millimoles) and biphenyl-4,4'-dicarboxylic acid dichloride (16.2 millimoles) were changed to a dicarboxylic acid dichloride (16.2 millimoles) of the compound (1-k) and a dicarboxylic acid dichloride (16.2 millimoles) of the compound (1-l). The produced polyarylate resin (R-1) had a viscosity average molecular weight of 35,300.

For producing the polyarylate resin (R-3), 2,6-naphthalene dicarboxylic acid dichloride (16.2 millimoles) and biphenyl-4,4'-dicarboxylic acid dichloride (16.2 millimoles) were changed to the dicarboxylic acid dichloride (32.4 millimoles) of the compound (1-g). The produced polyarylate resin (R-3) had a viscosity average molecular weight of 36,600.

For producing the polyarylate resin (R-4), 2,6-naphthalene dicarboxylic acid dichloride (16.2 millimoles) and biphenyl-4,4'-dicarboxylic acid dichloride (16.2 millimoles) were changed to the dicarboxylic acid dichloride (16.2 millimoles) of the compound (1-g) and the dicarboxylic acid dichloride (16.2 millimoles) of the compound (1-jj). The produced polyarylate resin (R-4) had a viscosity average molecular weight of 34,400.

For producing the polyarylate resin (R-5), 2,6-naphthalene dicarboxylic acid dichloride (16.2 millimoles) and biphenyl-4,4'-dicarboxylic acid dichloride (16.2 millimoles) were changed to the dicarboxylic acid dichloride (16.2 millimoles) of the compound (1-g) and the dicarboxylic acid dichloride (16.2 millimoles) of the compound (1-h). The produced polyarylate resin (R-5) had a viscosity average molecular weight of 35,600.

For producing the polyarylate resin (R-6), 2,6-naphthalene dicarboxylic acid dichloride (16.2 millimoles) and biphenyl-4,4'-dicarboxylic acid dichloride (16.2 millimoles) were changed to the dicarboxylic acid dichloride (32.4 millimoles) of the compound (1-i). The produced polyarylate resin (R-6) had a viscosity average molecular weight of 35,800.

For producing the polyarylate resin (R-7), 2,6-naphthalene dicarboxylic acid dichloride (16.2 millimoles) and biphenyl-4,4'-dicarboxylic acid dichloride (16.2 millimoles) were changed to the dicarboxylic acid dichloride (16.2 millimoles) of the compound (1-i) and the dicarboxylic acid dichloride (16.2 millimoles) of the compound (1-jj). The produced polyarylate resin (R-7) had a viscosity average molecular weight of 34,000.

For producing the polyarylate resin (R-8), 2,6-naphthalene dicarboxylic acid dichloride (16.2 millimoles) and biphenyl-4,4'-dicarboxylic acid dichloride (16.2 millimoles) were changed to the dicarboxylic acid dichloride (9.7 millimoles) of the compound (1-g) and the dicarboxylic acid dichloride (22.7 millimoles) of the compound (1-jj). The produced polyarylate resin (R-8) had a viscosity average molecular weight of 33,600.

Next, $^1$H-NMR spectra of the respective produced polyarylate resins (R-1)-(R-8) were measured using a proton nuclear magnetic resonance spectrometer (product of JASCO Corporation, 300 MHz). $CDCl_3$ was used as a solvent. Tetramethylsilane (TMS) was used as an internal standard sample. The polyarylate resins (R-2), (R-4), and (R-5) will be discussed as typical examples among the produced polyarylate resins (R-1)-(R-8).

Figure 3:
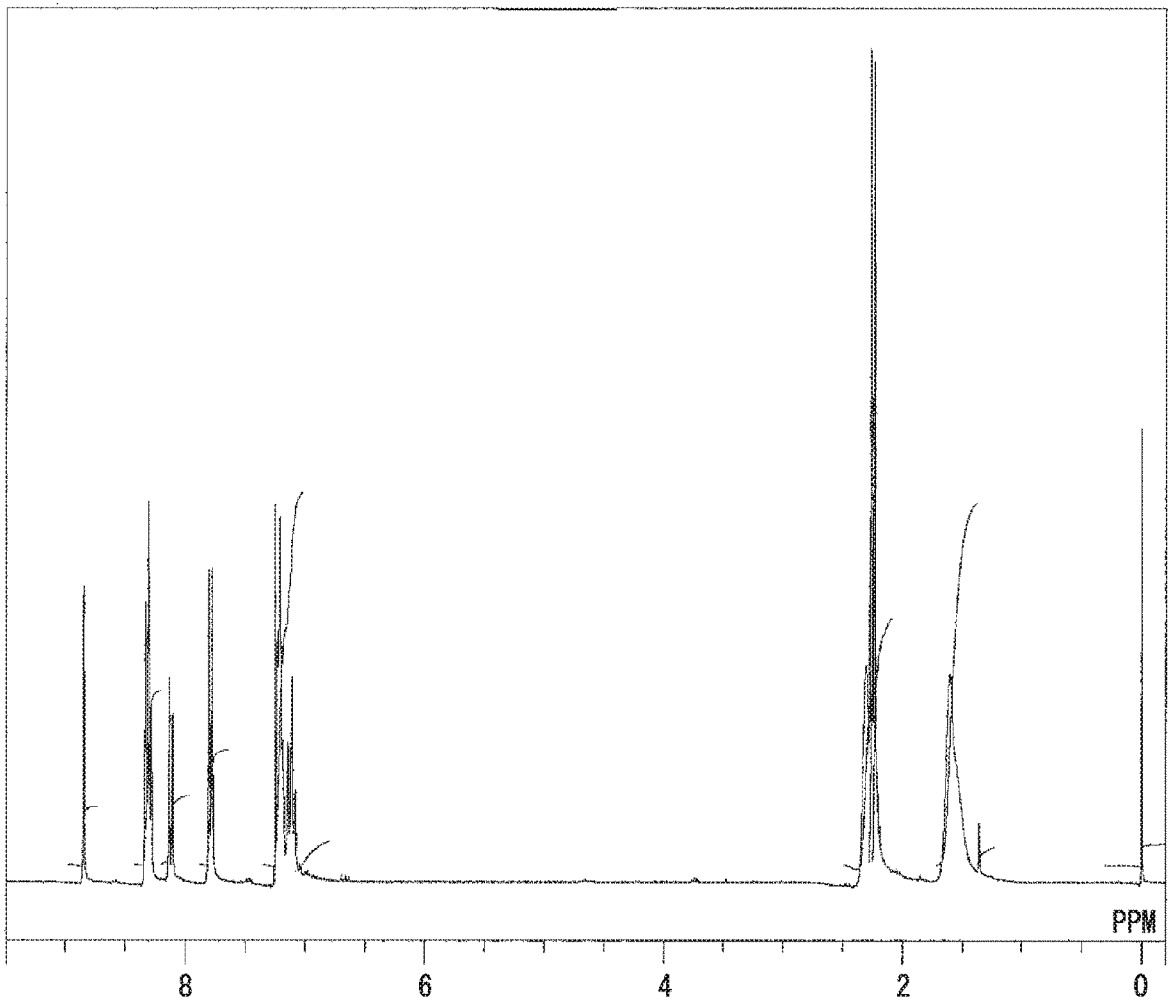
FIG. 3 is a $^{1}$H-NMR spectrum of a polyarylate resin represented by chemical formula (R-2).
Figure 4:
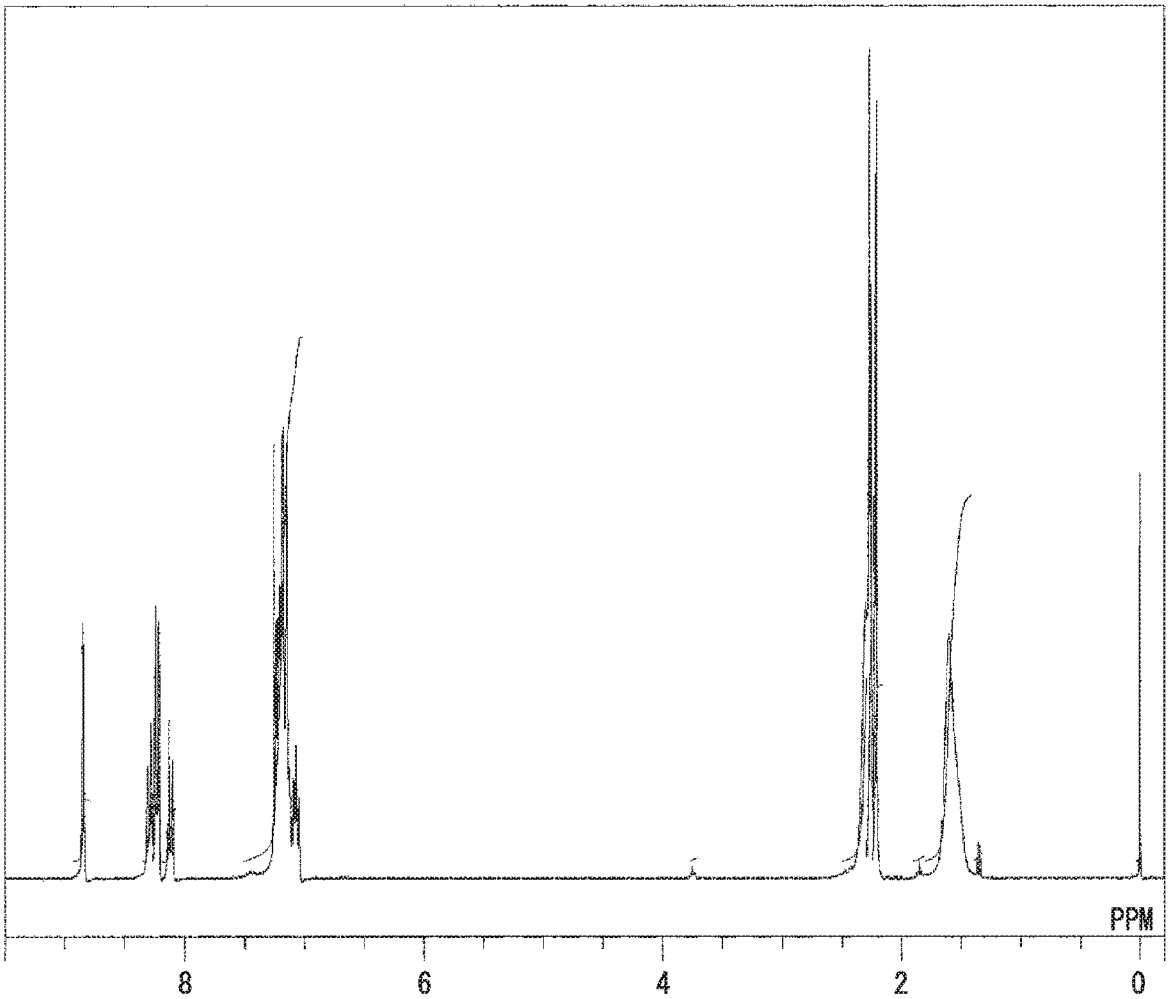
FIG. 4 is a $^{1}$H-NMR spectrum of a polyarylate resin represented by chemical formula (R-4).
Figure 5:
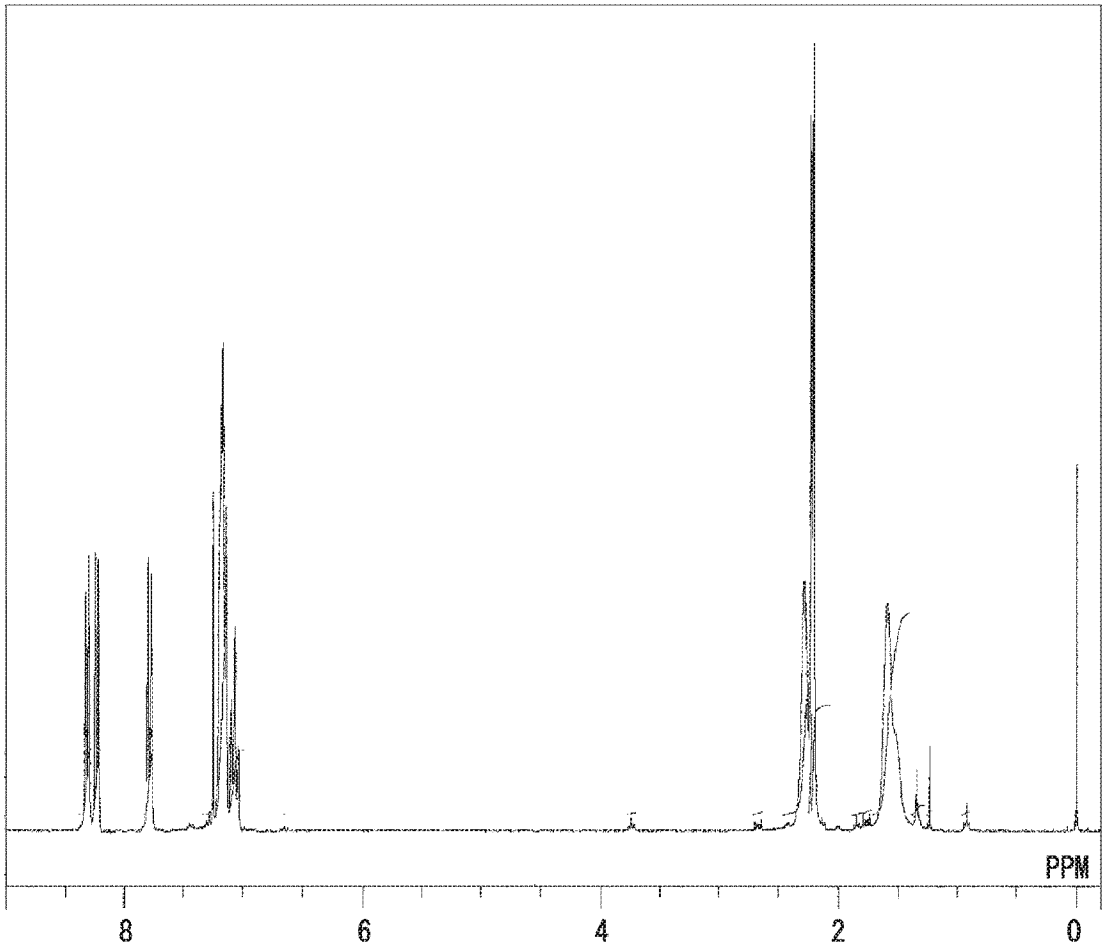
FIG. 5 is a $^{1}$H-NMR spectrum of a polyarylate resin represented by chemical formula (R-5).

FIGS. 3-5 show $^1$H-NMR spectra of the polyarylate resins (R-2), (R-4), and (R-5), respectively. In FIGS. 3-5, the horizontal axis represents chemical shift (unit: ppm) while the vertical axis represents signal strength (unit: arbitrary unit). It was confirmed from the $^1$H-NMR spectra that the respective polyarylate resins (R-2), (R-4), and (R-5) were produced. As to the polyarylate resins (R-1), (R-3), and (R-6)-(R-8), it was also confirmed from $^1$H-NMR spectra that the respective polyarylate resins (R-1), (R-3), and (R-6)-(R-8) were produced.

Polycarbonate resins represented by the following chemical formulas (R-A)-(R-C) (also referred to below as polycarbonate resins (R-A)-(R-C), respectively) were each prepared also as a binder resin. Polyarylate resins represented by the following chemical formulas (R-D)-(R-F) (also referred to below as polyarylate resins (R-D)-(R-F), respectively) were each prepared as a binder resin also. The polycarbonate resins (R-A)-(R-C) and the polyarylate resins (R-D)-(R-F) had viscosity average molecular weights of 31,000, 32,500, 33,000, 34,500, 33,200, and 32,400, respectively. Subscripts appended to respective repeating units in chemical formulas (R-A)-(R-F) each indicate a percentage of an amount (number of moles) of a corresponding one of the repeating units to which the respective subscripts are appended relative to a total amount (total number of moles) of the repeating units in a corresponding one of the resins.

(R-A)

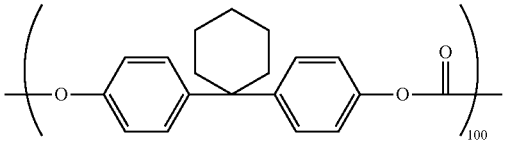

(R-B)

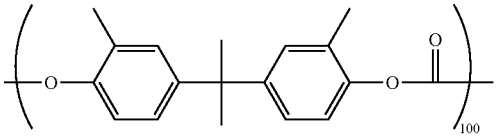

(R-C)

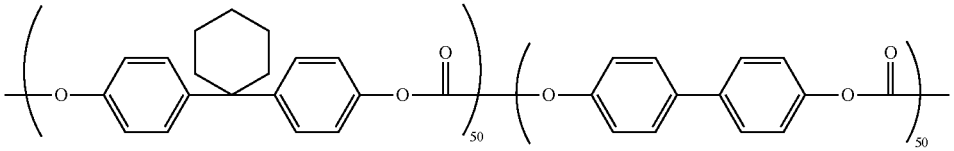

-continued (R-D)

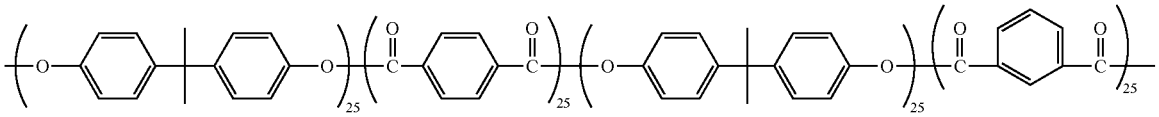

(R-E)

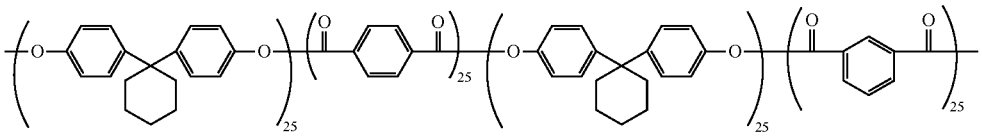

(R-F)

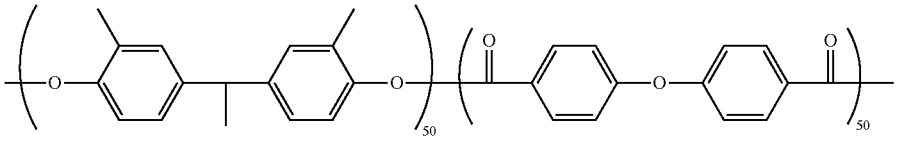

<Production of Photosensitive Member>

Photosensitive members (P-A1)-(P-A26) and (P-B1)-(P-B20) were produced using the materials for forming photosensitive layers.

(Production of Photosensitive Member (P-A1))

To a container, 2 parts by mass of X-form metal-free phthalocyanine as the charge generating material, 50 parts by mass of the compound (HTM1-1) as the hole transport material, 30 parts by mass of the compound (ETM1-1) as the electron transport material, 120 parts by mass of the polyarylate resin (R-1) as a binder resin, and 800 parts by mass of tetrahydrofuran as a solvent were added. The container contents were mixed for 50 hours using a ball mill to disperse the materials in the solvent. Through the above, an application liquid for photosensitive layer formation was yielded. The application liquid for photosensitive layer formation was applied to a drum-shaped aluminum support member (diameter: 30 mm, total length: 238.5 mm) as a conductive substrate by dip coating. The applied application liquid for photosensitive layer formation was hot-air dried for 60 minutes at a temperature of 120° C. Through the above, a photosensitive layer (film thickness: 30 μm) was formed on the conductive substrate. As a result, the photosensitive member (P-A1) was produced.

(Production of Photosensitive Members (P-A2)-(P-A26) and (P-B1)-(P-B20))

Photosensitive members (P-A2)-(P-A26) and (P-B1)-(P-B20) were produced according to the same method as for the photosensitive member (P-A1) in all aspects except that the following points (1) and (2) were changed.

(1) The polyarylate resin (R-1) used for production of the photosensitive member (P-A1) was changed to respective binder resins indicated in Tables 1 and 2.

(2) The amount of the binder resin was changed from 120 parts by mass in production of the photosensitive member (P-A1) to those listed in Tables 1 and 2. Accordingly, the ratio of the amount of the binder resin relative to the total amount of the photosensitive layer was changed from 0.40 for the photosensitive member (P-A1) to those listed in Tables 1 and 2.

<Scratch Depth Measurement>

Scratch depth measurement was performed on the photosensitive layers of the respective photosensitive members (P-A1)-(P-A26) and (P-B1)-(P-B20). The scratch depth measurement was performed using a scratching apparatus 200 defined in JIS K5600-5-5 (Japan Industrial Standard 5600: Testing methods for paints, Part 5: Mechanical Property of Film, Section 5: Scratch Hardness (Stylus method)).

Figure 6:
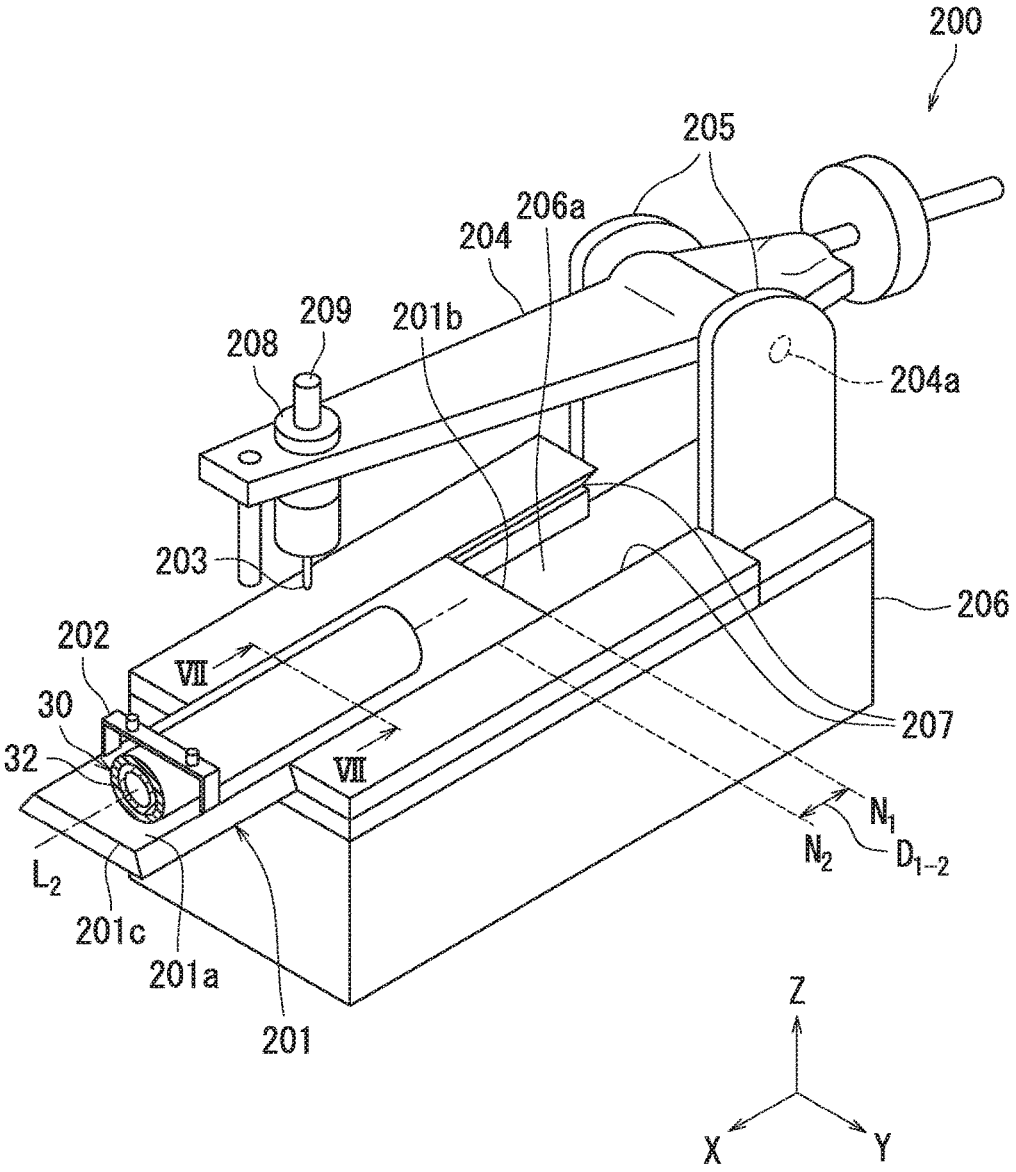
FIG. 6 illustrates an example of a configuration of a scratching apparatus.

The following describes the scratching apparatus 200 with reference to FIG. 6. FIG. 6 illustrates an example of a configuration of the scratching apparatus 200. The scratching apparatus 200 includes a fixing table 201, a fixing jig 202, a scratching stylus 203, a support arm 204, two shaft supports 205, a base 206, two rails 207, a weight pan 208, and a constant speed motor (not illustrated).

In FIG. 6, X and Y directions each are a horizontal direction and a Z direction is a vertical direction. The X direction coincides with a longitudinal direction of the fixing table 201. The Y direction coincides with a direction perpendicular to the X direction on a plane parallel to an upper surface 201*a* (placement surface) of the fixing table 201. Note that X, Y, and Z directions in FIGS. 7-9, which will be described later, are the same as those in FIG. 6.

The fixing table 201 corresponds to a fixing table for fixing a standard panel for testing in JIS K5600-5-5. The fixing table 201 has the upper surface 201*a*, one end 201*b*, and another end 201*c*. The one end 201*b* is opposite to the two shaft supports 205.

The fixing jig 202 is disposed on a side of the other end 201*c* of the upper surface 201*a* of the fixing table 201. The fixing jig 202 fixes a measurement target (photosensitive member 30) to the upper surface 201*a* of the fixing table 201. The upper surface 201*a* of the fixing table 201 is horizontal.

The scratching stylus 203 has a hemispherical tip end 203*b* (see FIG. 7) having a diameter of 1 mm. The tip end 203*b* of the scratching stylus 203 is made from sapphire.

The support arm 204 supports the scratching stylus 203. The support arm 204 pivots about the support shaft 204*a* as a pivot center in a direction in which the scratching stylus 203 moves to and away from the photosensitive member 30.

The two shaft supports 205 support the support arm 204 in a pivotal manner.

The base 206 has an upper surface 206*a* having one end located on a side where the two shaft supports 205 are disposed.

The two rails 207 are disposed on a side of the other end of the upper surface 206*a* of the base 206. The two rails 207 are disposed in parallel to each other. The two rails 207 are each disposed in parallel to the longitudinal direction (X direction) of the fixing table 201. The fixing table 201 is disposed between the two rails 207. The fixing table 201 is movable horizontally in the longitudinal direction (X direction) of the fixing table 201 along the rails 207.

The weight pan 208 is placed on the scratching stylus 203 with the support arm 204 therebetween. A weight 209 is placed on the weight pan 208.

The constant speed motor moves the fixing table 201 in the longitudinal direction (X direction) of the fixing table 201 along the rails 207.

The scratch depth measuring method will be described below. The scratch depth measuring method included a first step, a second step, a third step, and a fourth step. The scratch depth measurement was performed using the scratching apparatus 200 defined in JIS K5600-5-5. A surface roughness tester ("HEIDON TYPE14" manufactured by Shinto Scientific Co., Ltd.) was used as the scratching apparatus 200. The scratch depth measurement was performed in an environment at a temperature of 23° C. and a relative humidity of 50% RH. A drum-shaped (cylindrical) photosensitive member was used as the measurement target. Employment of the following scratch depth measuring method could result in precise measurement of characteristics of a photosensitive layer that affect occurrence of fogging in a formed image.

(First Step)

In the first step, a photosensitive member 30 was fixed to the upper surface 201*a* of the fixing table 201 such that the longitudinal direction of the photosensitive member 30 coincides with the longitudinal direction of the fixing table 201. A direction of a central axis $L_2$ (rotational axis) of the photosensitive member 30 coincides with the longitudinal direction of the photosensitive member 30. Note that in a configuration in which the photosensitive member 30 has a sheet-like shape, a direction of a long side of the photosensitive member 30 corresponds to the longitudinal direction of the photosensitive member 30.

(Second Step)

Figure 7:
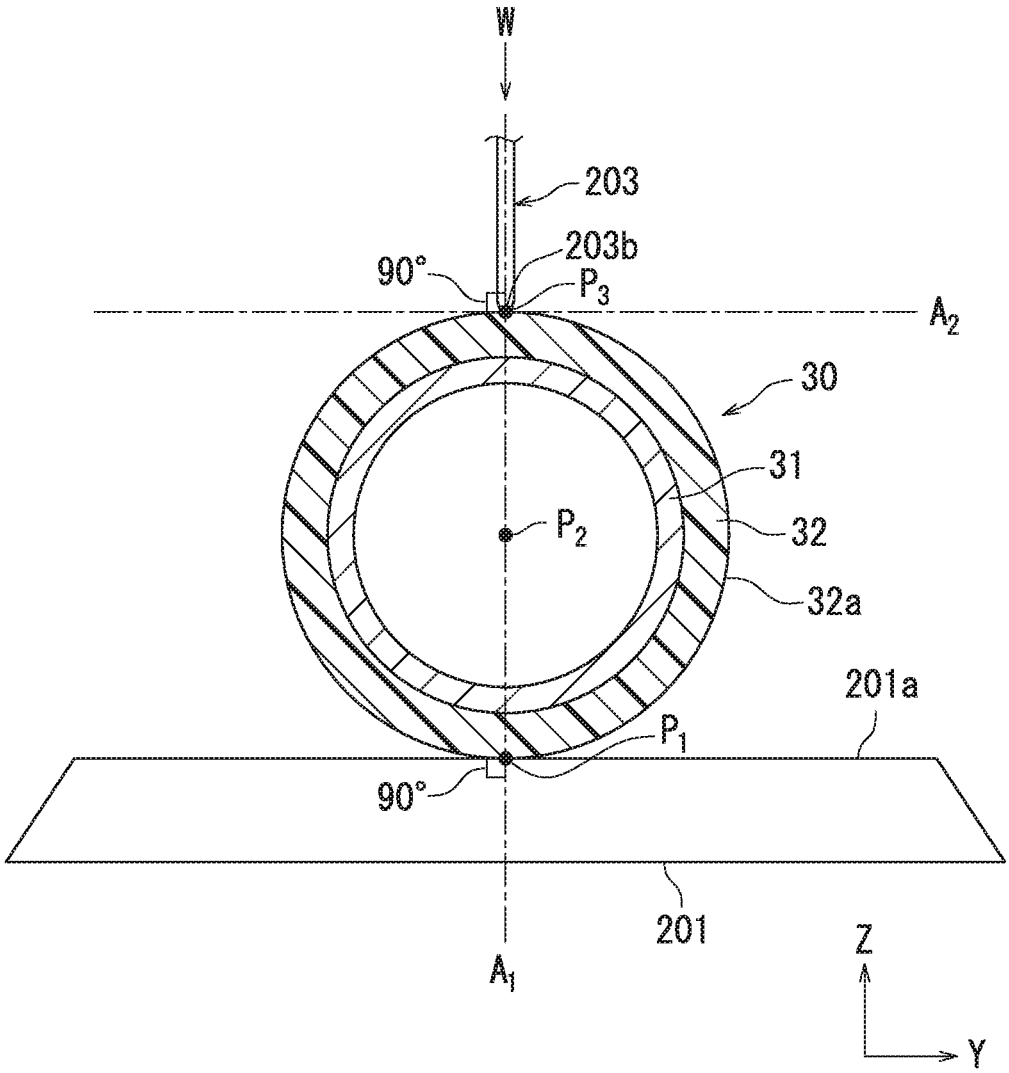
FIG. 7 is a cross-sectional view taken along the line VII-VII in FIG. 6.
Figure 8:
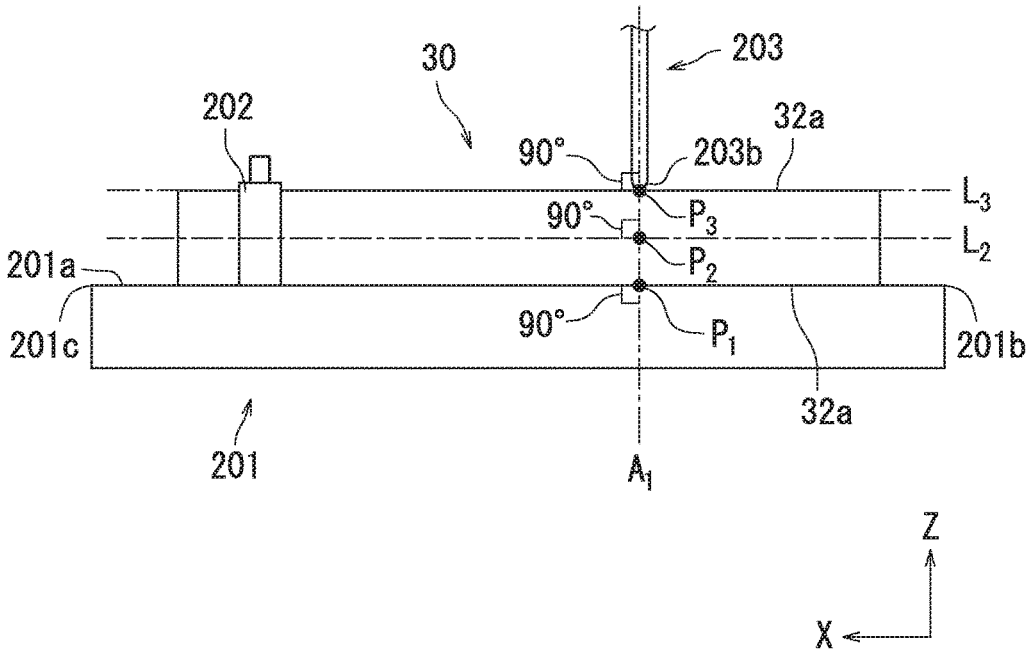
FIG. 8 is a side view of a fixing table, a scratching stylus, and an electrophotographic photosensitive member illustrated in FIG. 6.
Figure 9:
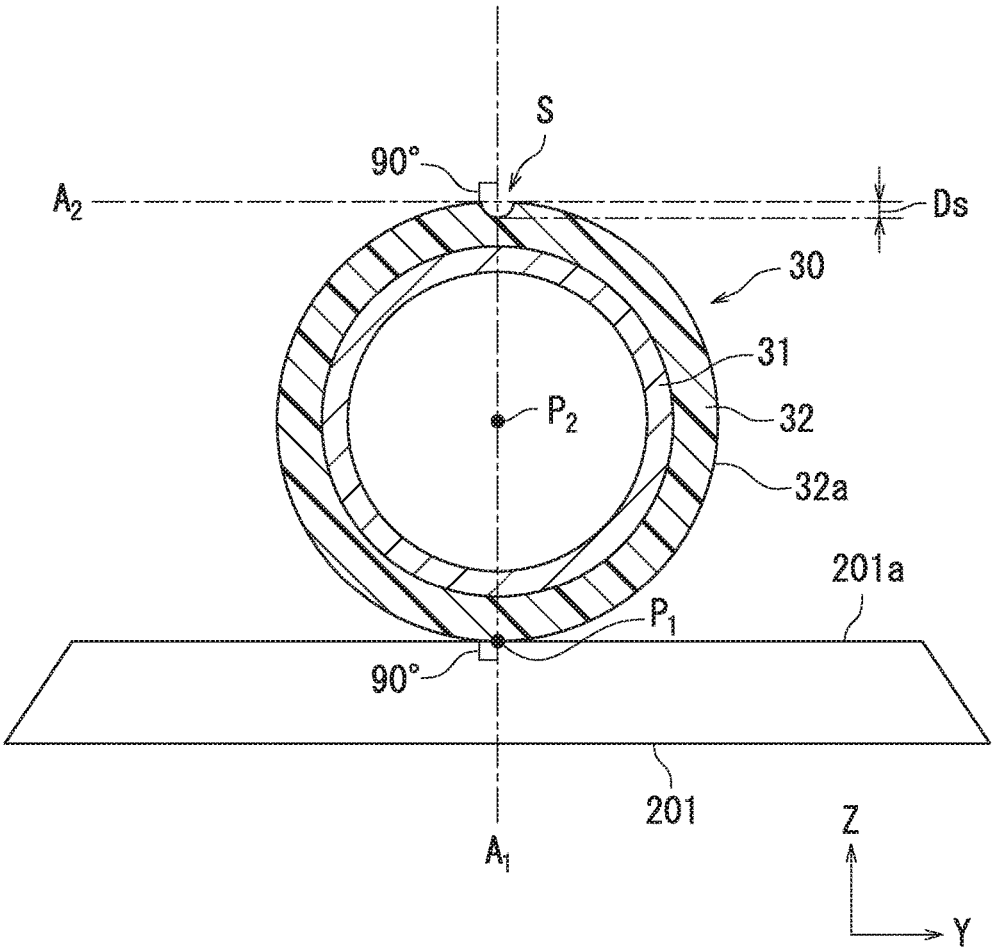
FIG. 9 illustrates a scratch formed on the surface of a photosensitive layer.

In the second step, the scratching stylus 203 was brought into perpendicular contact with a surface 32*a* of a photosensitive layer 32 of the photosensitive member 30. A manner to bring the scratching stylus 203 into perpendicular contact with the surface 32*a* of the photosensitive layer 32 of the drum-shaped photosensitive member 30 will be described with reference to FIGS. 7 and 8 in addition to FIG. 6. FIG. 7 is a cross-sectional view taken along the line VII-VII in FIG. 6. FIG. 7 is a cross-sectional view of the scratching stylus 203 in contact with the photosensitive member 30. FIG. 8 is a side view of the fixing table 201, the scratching stylus 203, and the photosensitive member 30 illustrated in FIG. 6.

The scratching stylus 203 was moved to the photosensitive member 30 such that an extension of a central axis $A_1$ of the scratching stylus 203 is perpendicular to the upper surface 201*a* of the fixing table 201. The tip end 203*b* of the scratching stylus 203 was then brought into contact with a point of the surface 32*a* of the photosensitive layer 32 of the photosensitive member 30 that is located farthest from the upper surface 201 of the fixing table 201 in a perpendicular direction (Z axial direction). Thus, the tip end 203*b* of the scratching stylus 203 was placed in contact with the surface 32*a* of the photosensitive layer 32 of the photosensitive member 30 at a contact point $P_3$. The tip end 203*b* of the scratching stylus 203 is in contact with the photosensitive member 30 such that the central axis $A_1$ of the scratching stylus 203 is perpendicular to a tangent $A_2$. The tangent $A_2$ is a tangent of the contact point $P_3$ to a circumscribed circle that a section of the photosensitive member 30 perpendicular to the central axis $L_2$ of the photosensitive member 30 forms. Thus, the scratching stylus 203 is placed in perpendicular contact with the surface 32*a* of the photosensitive layer 32 of the photosensitive member 30. Note that in a configuration in which the photosensitive member 30 has a sheet-like shape, the scratching stylus 203 is brought into contact with the surface 32*a* of the photosensitive layer 32 such that the extension of the central axis $A_1$ of the scratching stylus 203 is perpendicular to the surface 32*a* (flat surface) of the photosensitive layer 32 of the photosensitive member 30.

A positional relationship among the fixing table 201, the photosensitive member 30, and the scratching stylus 203 was as follows when the scratching stylus 203 was placed in contact with the photosensitive layer 32 of the photosensitive member 30 through the above process. The extension of the central axis $A_1$ of the scratching stylus 203 and the central axis $L_2$ of the photosensitive member 30 perpendicularly intersected with each other at an intersection point $P_2$. The contact point $P_1$ between the photosensitive layer 32 and the upper surface 201*a* of the fixing table 201, the intersection point $P_2$, and the contact point $P_3$ between the photosensitive layer 32 and the tip end 203*b* of the scratching stylus 203 were aligned on the extension of the central axis $A_1$ of the scratching stylus 203. Further, the extension of the central axis $A_1$ of the scratching stylus 203 was perpendicular to the tangent $A_2$ and the upper surface 201 of the fixing table 201.

(Third Step)

In the third step, 10 g of a load W was applied to the photosensitive layer 32 through the scratching stylus 203 in a state in which the scratching stylus 203 was in perpendicular contact with the surface 32*a* of the photosensitive layer 32. Specifically, a weight 209 having a weight of 10 g was placed on the weight pan 208. The fixing table 201 was moved in this state. Specifically, the constant speed motor was driven to horizontally move the fixing table 201 in the longitudinal direction thereof (X direction) along the rails 207. In other words, the one end 201*b* of the fixing table 201 was moved from a first point $N_1$ to a second point $N_2$. The second point $N_2$ was located downstream of the first point $N_1$ in a direction in which the fixing table 201 is away from the two shaft supports 205 in the longitudinal direction of the fixing table 201. The photosensitive member 30 was also moved horizontally in the longitudinal direction of the fixing table 201 along with the movement of the fixing table 201 in the longitudinal direction thereof. The travel speed of the fixing table 201 and the photosensitive member 30 was 30 mm/min. The travel distance of the fixing table 201 and the photosensitive member 30 was 30 mm. The travel distance of the fixing table 201 and the photosensitive member 30 corresponds to a distance $D_{1-2}$ between the first and second points $N_1$ and $N_2$. As a result of the movement of the fixing table 201 and the photosensitive member 30, a scratch S was formed on the surface 32*a* of the photosensitive layer 32 of the photosensitive member 30 by the scratching stylus 203. The scratch S will be described with reference to FIG. 9 in addition to FIGS. 6-8, FIG. 9 illustrates the scratch S formed on the surface 32*a* of the photosensitive layer 32. The formed scratch S was perpendicular relative to the upper surface 201*a* of the fixing table 201 and the tangent $A_2$. The formed scratch S was along a line $L_3$ in FIG. 8. The line $L_3$ is aggregation of a plurality of contact points $P_3$. The line $L_3$ is parallel to the upper surface 201*a* of the fixing table 201 and the central axis $L_2$ of the photosensitive member 30. The line $L_3$ was perpendicular to the central axis $A_1$ of the scratching stylus 203.

(Fourth Step)

In the fourth step, a scratch depth that is a maximum depth $Ds_{max}$, of the scratch S was measured. Specifically, the photosensitive member 30 was taken out from the fixing table 201. The scratch S formed on the photosensitive layer 32 of the photosensitive member 30 was observed at a magnification of 5× using a three-dimensional interference microscope ("WYKO NT-1100" available at Bruker Corporation) to measure depths Ds of the scratch S. The depths Ds of the scratch S each corresponded to a distance from the tangent $A_2$ to a bottom part of the scratch S. A maximum depth $Ds_{max}$ among the depths Ds of the scratch S was determined to be a scratch depth. Measured scratch depths unit: μm) are indicated in Tables 1 and 2.

<Anti-Fogging Property Evaluation>

Anti-fogging property evaluation was performed on images formed using the respective photosensitive members (P-A1)-(P-A26) and (P-B1)-(P-B20). The anti-fogging property evaluation was performed in an environment at a temperature of 32.5° C. and a humidity of 80% RH.

An image forming apparatus (modified version of a monochrome printer "FS-1300D" manufactured by KYOCERA Document Solutions Inc.) was used as an evaluation apparatus. The image forming apparatus performs direct transfer and contact development and includes no cleaner. The image forming apparatus includes a developing device that cleans toner remaining on a photosensitive member. The image forming apparatus includes a charging roller as a charger. Paper used for evaluation was Brand Paper of KYOCERA Document Solutions, VM-A4 (A4 size) available at KYOCERA Document Solutions Inc. The evaluation using the evaluation apparatus used a one-component developer (prototype).

An image I was successively printed on 12,000 pieces of the paper using the evaluation apparatus at a rotational speed of the photosensitive member of 168 mm/sec. The image I had a coverage rate of 1%. A white image was printed on a single piece of the paper then. Respective image densities of three parts of the printed white image were measured using a reflectance densitometer ("RD914" manufactured by X-Rite Inc.). A sum of the image densities of the three parts of the white image was divided by the number of measured parts. Through the above, a number average of the image densities of the white image was calculated. A value obtained by subtracting an image density of base paper from the number average value of the image densities of the white image was determined as a fogging density. The following evaluation criteria were used for evaluation of calculated fogging densities. A photosensitive member evaluated as A was determined to be excellent in anti-fogging property. The fogging densities (FD values) and evaluation results are indicated in Tables 1 and 2.

Evaluation Criteria for Anti-fogging Property

Evaluation A: Fogging density is no greater than 0.010.

Evaluation B: Fogging density is greater than 0.010 and no greater than 0.020.

Evaluation C: Fogging density is greater than 0.020.

<Evaluation of Sensitivity Characteristics>

Evaluation of sensitivity characteristics was performed on each of the photosensitive members (P-A1)-(P-A26) and (P-B1)-(P-B20). The evaluation of the sensitivity characteristics was performed in an environment at a temperature of 23° C. and a relative humidity of 50% RH. First, the surface of the photosensitive member was charged to +600 V using a drum sensitivity test device (product of Gen-Tech, Inc.). Monochromatic light (wavelength: 780 nm, half-width: 20 nm, optical energy: 1.5 μJ/cm$^2$) was taken out from white light of a halogen lamp using a bandpass filter. The surface of the photosensitive member was irradiated with the taken monochromatic light. The surface potential of the photosensitive member was measured after 0.5 seconds elapsed from termination of the irradiation. The measured surface potential was determined as a sensitivity potential (also referred to below as a post-exposure potential $V_L$, unit: +V). Measured post-exposure potentials ($V_L$) of the respective photosensitive members are indicated in Tables 1 and 2. The smaller the positive value of the post-exposure potential ($V_L$) is, the more excellent it is indicated that the sensitivity characteristics of the photosensitive member is.

R-1-R-8 in Tables 1 and 2 represent the polyarylate resins (R-1)-(R-8), respectively. R-A-R-F in Tables 1 and 2 represent the polycarbonate resins (R-A)-(R-C) and the polyarylate resins (R-D)-(R-F), respectively. In Tables 1 and 2, "Part", "FD", and "$V_L$" represent parts by mass, fogging density, and post-exposure potential, respectively. In Tables 1 and 2, "Ratio" in "Binder resin" represents the ratio of a mass of a binder resin relative to a total mass of a photosensitive layer. The ratio of the binder resin is calculated using the following expression.

Ratio of binder resin=(mass of binder resin)/((mass of charge generating material)+(mass of hole transport material)+(mass of electron transport material)+(mass of binder resin))

TABLE 1

| | Photosensitive member | Scratch depth (μm) | Binder resin Type | Binder resin Mass (part) | Binder resin Ratio | Anti-fogging property FD | Anti-fogging property Evaluation | $V_L$ (+V) |
|---|---|---|---|---|---|---|---|---|
| Example 1 | P-A1 | 0.39 | R-1 | 120 | 0.59 | 0.004 | A | 129 |
| Example 2 | P-A2 | 0.46 | R-1 | 100 | 0.55 | 0.008 | A | 100 |
| Example 3 | P-A3 | 0.50 | R-1 | 80 | 0.49 | 0.009 | A | 79 |
| Example 4 | P-A4 | 0.10 | R-2 | 120 | 0.59 | 0.002 | A | 130 |
| Example 5 | P-A5 | 0.14 | R-2 | 100 | 0.55 | 0.003 | A | 102 |
| Example 6 | P-A6 | 0.30 | R-2 | 80 | 0.49 | 0.004 | A | 78 |
| Example 7 | P-A7 | 0.35 | R-3 | 120 | 0.59 | 0.004 | A | 133 |
| Example 8 | P-A8 | 0.43 | R-3 | 100 | 0.55 | 0.008 | A | 103 |
| Example 9 | P-A9 | 0.47 | R-3 | 80 | 0.49 | 0.007 | A | 80 |
| Example 10 | P-A10 | 0.29 | R-4 | 120 | 0.59 | 0.003 | A | 130 |
| Example 11 | P-A11 | 0.32 | R-4 | 100 | 0.55 | 0.004 | A | 101 |
| Example 12 | P-A12 | 0.44 | R-4 | 80 | 0.49 | 0.008 | A | 81 |
| Example 13 | P-A13 | 0.25 | R-5 | 120 | 0.59 | 0.004 | A | 129 |
| Example 14 | P-A14 | 0.30 | R-5 | 100 | 0.55 | 0.003 | A | 99 |

TABLE 1-continued

| | Photosensitive member | Scratch depth (μm) | Binder resin Type | Binder resin Mass (part) | Binder resin Ratio | Anti-fogging property FD | Anti-fogging property Evaluation | $V_L$ (+V) |
|---|---|---|---|---|---|---|---|---|
| Example 15 | P-A15 | 0.39 | R-5 | 80 | 0.49 | 0.005 | A | 76 |
| Example 16 | P-A16 | 0.38 | R-6 | 120 | 0.59 | 0.006 | A | 134 |
| Example 17 | P-A17 | 0.45 | R-6 | 100 | 0.55 | 0.009 | A | 102 |
| Example 18 | P-A18 | 0.49 | R-6 | 80 | 0.49 | 0.009 | A | 79 |
| Example 19 | P-A19 | 0.34 | R-1 | 130 | 0.61 | 0.004 | A | 182 |
| Example 20 | P-A20 | 0.08 | R-2 | 130 | 0.61 | 0.001 | A | 190 |
| Example 21 | P-A21 | 0.42 | R-7 | 120 | 0.59 | 0.008 | A | 133 |
| Example 22 | P-A22 | 0.47 | R-7 | 100 | 0.55 | 0.008 | A | 106 |
| Example 23 | P-A23 | 0.50 | R-7 | 80 | 0.49 | 0.009 | A | 80 |
| Example 24 | P-A24 | 0.17 | R-8 | 120 | 0.59 | 0.003 | A | 134 |
| Example 25 | P-A25 | 0.24 | R-8 | 100 | 0.55 | 0.004 | A | 101 |
| Example 26 | P-A26 | 0.33 | R-8 | 80 | 0.49 | 0.006 | A | 78 |

TABLE 2

| | Photosensitive member | Scratch depth (μm) | Binder resin Type | Binder resin Mass (part) | Binder resin Ratio | Anti-fogging property FD | Anti-fogging property Evaluation | $V_L$ (+V) |
|---|---|---|---|---|---|---|---|---|
| Comparative Example 1 | P-B1 | 0.57 | R-1 | 70 | 0.46 | 0.013 | B | 70 |
| Comparative Example 2 | P-B2 | 0.60 | R-2 | 70 | 0.46 | 0.014 | B | 72 |
| Comparative Example 3 | P-B3 | 1.10 | R-A | 120 | 0.59 | 0.058 | C | 133 |
| Comparative Example 4 | P-B4 | 0.88 | R-A | 100 | 0.55 | 0.032 | C | 101 |
| Comparative Example 5 | P-B5 | 0.80 | R-A | 80 | 0.49 | 0.030 | C | 80 |
| Comparative Example 6 | P-B6 | 1.40 | R-B | 120 | 0.59 | 0.088 | C | 136 |
| Comparative Example 7 | P-B7 | 0.91 | R-B | 100 | 0.55 | 0.035 | C | 101 |
| Comparative Example 8 | P-B8 | 0.83 | R-B | 80 | 0.49 | 0.032 | C | 77 |
| Comparative Example 9 | P-B9 | 0.64 | R-C | 120 | 0.59 | 0.023 | C | 133 |
| Comparative Example 10 | P-B10 | 0.70 | R-C | 100 | 0.55 | 0.029 | C | 100 |
| Comparative Example 11 | P-B11 | 0.78 | R-C | 80 | 0.49 | 0.030 | C | 78 |
| Comparative Example 12 | P-B12 | 0.62 | R-D | 120 | 0.59 | 0.023 | C | 130 |
| Comparative Example 13 | P-B13 | 0.89 | R-D | 100 | 0.55 | 0.044 | C | 99 |
| Comparative Example 14 | P-B14 | 0.82 | R-D | 80 | 0.49 | 0.040 | C | 79 |
| Comparative Example 15 | P-B15 | unmeasurable | R-E | 120 | 0.59 | unmeasurable | | |
| Comparative Example 16 | P-B16 | unmeasurable | R-E | 100 | 0.55 | unmeasurable | | |
| Comparative Example 17 | P-B17 | unmeasurable | R-E | 80 | 0.49 | unmeasurable | | |
| Comparative Example 18 | P-B18 | 0.53 | R-F | 120 | 0.59 | 0.013 | B | 136 |
| Comparative Example 19 | P-B19 | 0.60 | R-F | 100 | 0.55 | 0.017 | B | 106 |
| Comparative Example 20 | P-B20 | 0.65 | R-F | 80 | 0.49 | 0.022 | C | 80 |

The photosensitive layers of the respective photosensitive members (P-A1)-(P-A26) each included a conductive substrate and a single-layer photosensitive layer. The photosensitive layers each contained the charge generating material, the hole transport material, the electron transport material, and a binder resin. Scratch depths of the respective photosensitive layers were no greater than 0.50 μm. As such, as evident from Table 1, the photosensitive members (P-A1)-(P-A26) were evaluated as A in the anti-fogging property evaluation and occurrence of fogging was reduced in an image formed using any of the photosensitive members (P-A1)-(P-A26).

The photosensitive members (P-A1)-(P-A18) and (P-A21)-(P-A26) each had the ratio of a mass of a corresponding one of the binder resins relative to a total mass of a corresponding one of the photosensitive layers of at least 0.47 and no greater than 0.60. As such, as evident from Table 1, the photosensitive members (P-A1)-(P-A18) and (P-A21)-(P-A26) were excellent in not only anti-fogging property but also sensitivity characteristics because the post-exposure potentials $V_L$ thereof each were a small positive value.

By contrast, the photosensitive layers of the respective photosensitive members (P-B1)-(P-B14) and (P-B18)-(P-B20) each had a scratch depth of greater than 0.50 μm. As such, as evident from Table 2, the photosensitive members (P-B1)-(P-B20) were evaluated as B or C in the anti-fogging property evaluation and fogging occurred in a formed image.

In the photosensitive members (P-B15)-(P-B17), the polyarylate resin (R-E) did not dissolve in the solvent for photosensitive layer formation, with a result that no photosensitive layer was formed. As such, none of a scratch depth, a fogging density, and a post-exposure potential could be measured as indicated in Table 2.

From the above, it is proved that occurrence of fogging could be reduced in an image formed using the photosensitive member according to the present disclosure. Furthermore, it is proved that occurrence of fogging in image formation could be reduced in an image formed using the process cartridge or the image forming apparatus according to the present disclosure.

What is claimed is:

1. An electrophotographic photosensitive member comprising a conductive substrate and a photosensitive layer as a single-layer, wherein the photosensitive layer contains a charge generating material, a hole transport material, an electron transport material, and a binder resin, the photosensitive layer has a scratch resistance depth of no greater than 0.50 μm, the scratch resistance depth of the photosensitive layer representing a hardness of the photosensitive layer containing the binder resin at a ratio of a mass of the binder resin relative to a total mass of the photosensitive layer of at least 0.47 and no greater than 0.60, the binder resin including a polyarylate resin represented by a general formula (1) shown below, (1)

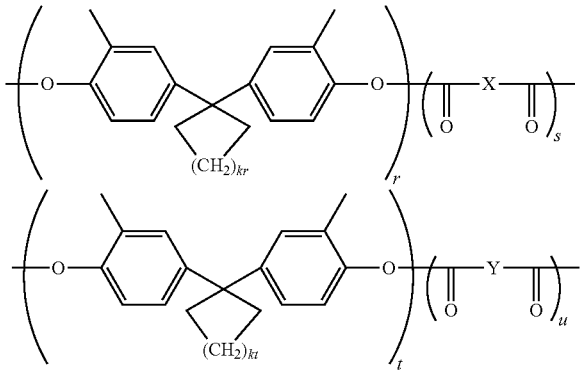

where, in the general formula (1), kr and kt each represent, independently of one another, 2 or 3, r+s+t+u=100, r+t=s+u, and r, s, t, and u each represent, independently of one another, a number of at least 1, s/(s+u) is greater than 0.00 and no greater than 0.90, one of X and Y represents a divalent group represented by a chemical formula (1-1), and the other of X and Y represents a divalent group represented by a chemical formula (1-2):

(1-1)

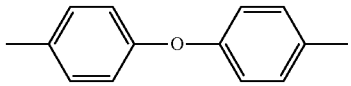

(1-2)

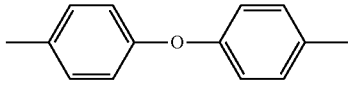

2. The electrophotographic photosensitive member according to claim 1, wherein in the general formula (1), r, s, t, and u each represent, independently of one another, a number of at least 1, s/(s+u) is greater than 0.00 and no greater than 0.90, and s and u are numbers different from each other.

3. The electrophotographic photosensitive member according to claim 1, wherein the electron transport material includes a compound represented by general formula (ETM1) shown below:

(ETM1)

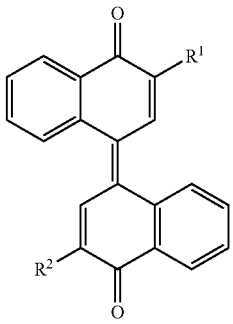

where, in the general formula (ETM1), $R^1$ and $R^2$ each represent, independently of one another, an alkyl group having 1 to 6 carbon atoms.

4. The electrophotographic photosensitive member according to claim 1, wherein the hole transport material includes a compound represented by general formula (HTM1) shown below:

(HTM1)

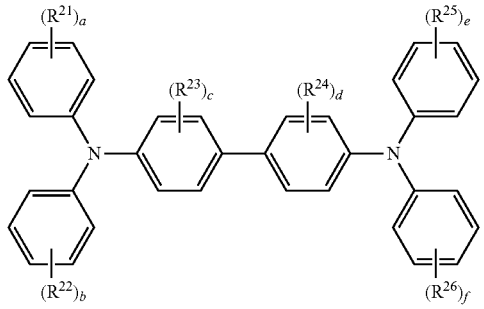

where, in the general formula (HTM1), $R^{21}$, $R^{22}$, $R^{23}$, $R^{24}$, $R^{25}$, and $R^{26}$ each represent, independently of one another, an alkyl group having 1 to 6 carbon atoms or an alkoxy group having 1 to 6 carbon atoms, a, b, e, and f each represent, independently of one another, an integer of at least 0 and no greater than 5, and c and d each represent, independently of one another, an integer of at least 0 and no greater than 4.

5. A process cartridge comprising the electrophotographic photosensitive member according to claim 1.

6. An image forming apparatus comprising the electrophotographic photosensitive member according to claim 1, a charger, an exposure section, a developing device, and a transfer section, wherein the charger is configured to positively charge a surface of the electrophotographic photosensitive member, the exposure section is configured to expose the charged surface of the electrophotographic photosensitive member to form an electrostatic latent image on the surface of the electrophotographic photosensitive member, the developing device is configured to develop the electrostatic latent image into a toner image, the transfer section is configured to transfer the toner image from the electrophotographic photosensitive member to a recording medium, and the electrophotographic photosensitive member is in contact with the recording medium during the transfer section transferring the toner image from the electrophotographic photosensitive member to the recording medium.

7. The image forming apparatus according to claim 6, wherein the developing device develops the electrostatic latent image into the toner image while in contact with the electrophotographic photosensitive member.

8. The image forming apparatus according to claim 6, wherein the developing device cleans the surface of the electrophotographic photosensitive member.

9. The image forming apparatus according to claim 6, wherein the charger is a charging roller.

10. An electrophotographic photosensitive member comprising a conductive substrate and a photosensitive layer as a single-layer, wherein the photosensitive layer contains a charge generating material, a hole transport material, an electron transport material, and a binder resin, the photosensitive layer has a scratch resistance depth of no greater than 0.50 μm, the scratch resistance depth of the photosensitive layer representing a hardness of the photosensitive layer containing the binder resin at a ratio of a mass of the binder resin relative to a total mass of the photosensitive layer of at least 0.47 and no greater than 0.60, the binder resin including a polyarylate resin represented by chemical formula (R-1), (R-2), (R-3), (R-4), (R-5), (R-6), (R-7), or (R-8) shown below:

(R-1)

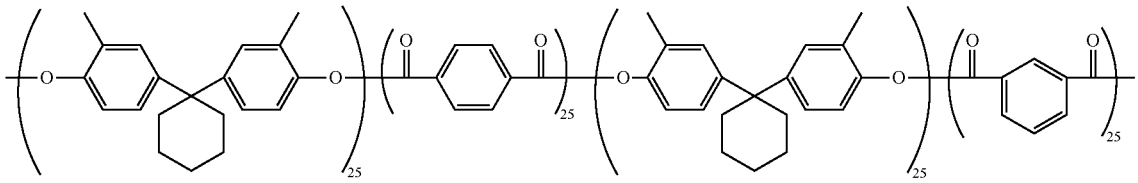

(R-2)

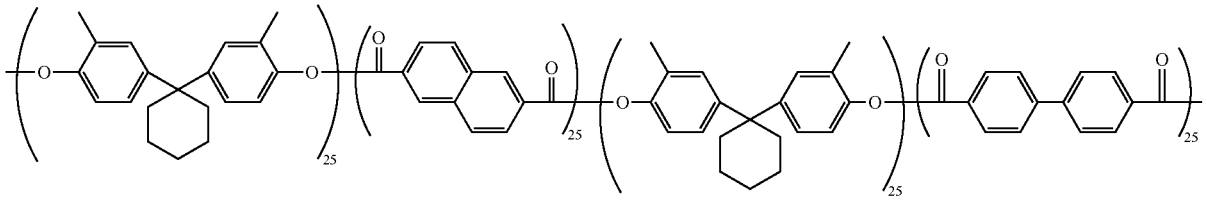

(R-3)

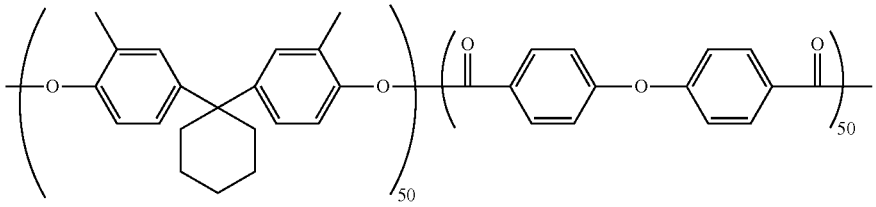

-continued
(R-4)
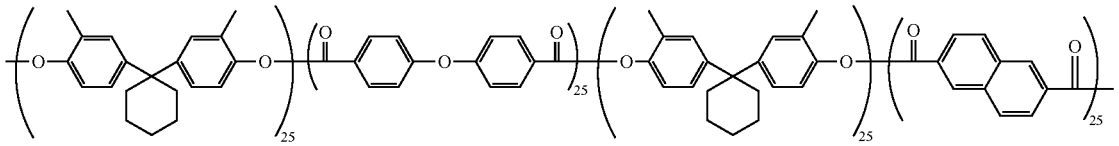
(R-5)
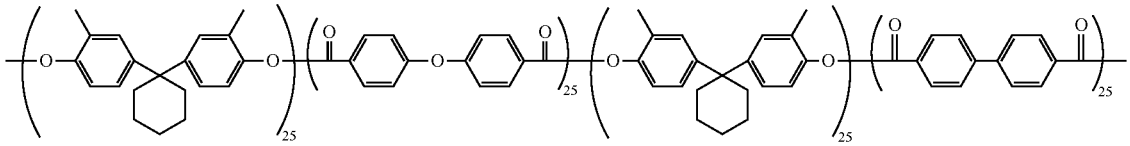
(R-6)
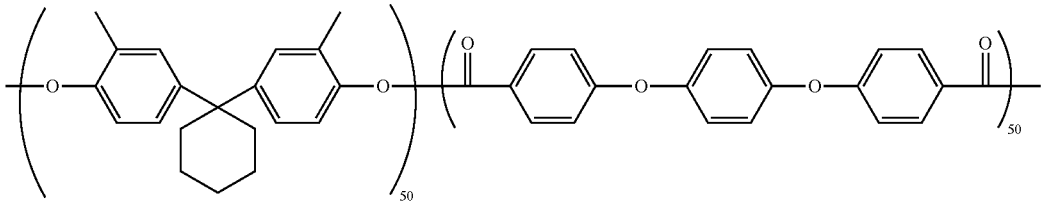
(R-7)
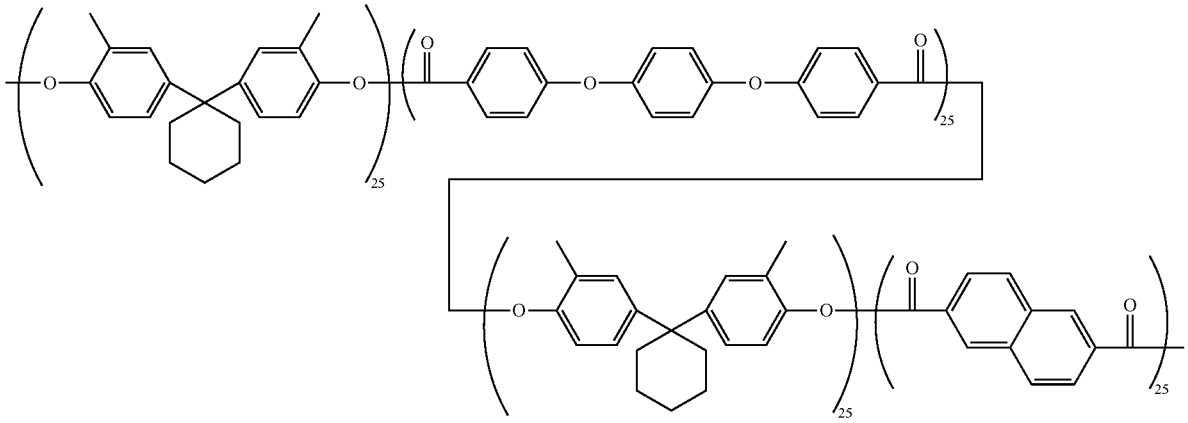
(R-8)
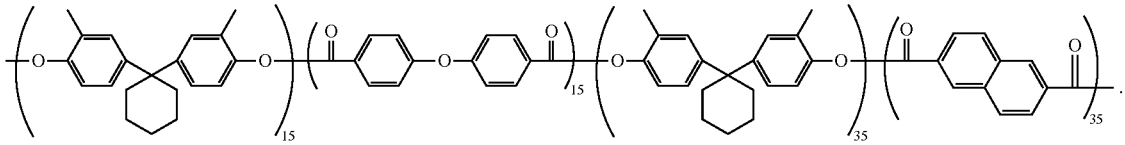
* * * * *